US009863023B2

(12) United States Patent
Ishii et al.

(10) Patent No.: US 9,863,023 B2
(45) Date of Patent: Jan. 9, 2018

(54) FERRITIC STAINLESS STEEL AND METHOD FOR MANUFACTURING THE SAME

(71) Applicant: JFE STEEL CORPORATION, Tokyo (JP)

(72) Inventors: Tomohiro Ishii, Chiba (JP); Shin Ishikawa, Chiba (JP); Hiroyuki Ogata, Chiba (JP); Hiroki Ota, Chiba (JP)

(73) Assignee: JFE Steel Corporation, Tokyo (JP)

( * ) Notice: Subject to any disclaimer, the term of this patent is extended or adjusted under 35 U.S.C. 154(b) by 329 days.

(21) Appl. No.: 14/437,015

(22) PCT Filed: Oct. 22, 2013

(86) PCT No.: PCT/JP2013/006231
§ 371 (c)(1),
(2) Date: Apr. 20, 2015

(87) PCT Pub. No.: WO2014/064920
PCT Pub. Date: May 1, 2014

(65) Prior Publication Data

US 2015/0275342 A1 Oct. 1, 2015

(30) Foreign Application Priority Data

Oct. 22, 2012 (JP) ..... 2012-232506
Feb. 28, 2013 (JP) ..... 2013-038202
Mar. 8, 2013 (JP) ..... 2013-046247

(51) Int. Cl.
*C22C 38/22* (2006.01)
*C22C 38/24* (2006.01)
(Continued)

(52) U.S. Cl.
CPC ..... *C22C 38/58* (2013.01); *B21B 1/22* (2013.01); *C21D 1/26* (2013.01); *C21D 6/004* (2013.01);
(Continued)

(58) Field of Classification Search
None
See application file for complete search history.

(56) References Cited

U.S. PATENT DOCUMENTS 4,059,440 A 11/1977 Takemura
2004/0154708 A1 8/2004 Takahashi
2014/0308154 A1 10/2014 Ishii

FOREIGN PATENT DOCUMENTS

AU 718297 9/1997
CN 1162653 10/1997
(Continued)

OTHER PUBLICATIONS

English abstract of Japanese publication No. 2003-041352 A, Yuji Kaga et al.*
(Continued)

*Primary Examiner* — Deborah Yee
(74) *Attorney, Agent, or Firm* — RatnerPrestia

(57) ABSTRACT

Provided are a ferritic stainless steel having a corrosion resistance at a certain level or more and a temper-color removal performance at a certain level or more and a method for manufacturing the ferritic stainless steel. A ferritic stainless steel has a composition containing, by mass %, C: 0.001% to 0.030%, Si: 0.03% to 0.30%, P: 0.05% or less, S: 0.01% or less, Cr: more than 22.0% to 28.0%, Mo: 0.2% to 3.0%, Al: 0.01% to 0.15%, Ti: more than 0.30% to 0.80%, V: 0.001% to 0.080%, and N: 0.001% to 0.050%; Mn: 0.05% to 0.30% and Ni: 0.01% to 5.00%, or Mn: 0.05% to 2.00% and Ni: 0.01% to 0.30%; Nb: 0.05% or less as an
(Continued)

optional component; and the balance being Fe and inevitable impurities, and the steel has a surface where TiN having a grain diameter of 1 μm or more is distributed at a density of 30 particles/mm$^2$ or more.

20 Claims, 1 Drawing Sheet

(51) Int. Cl.

| | |
|---|---|
| ***C22C 38/26*** | (2006.01) |
| ***C22C 38/28*** | (2006.01) |
| ***C21D 7/02*** | (2006.01) |
| ***C25F 1/06*** | (2006.01) |
| ***C22C 38/58*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C25F 1/00*** | (2006.01) |
| ***B21B 1/22*** | (2006.01) |
| ***C21D 1/26*** | (2006.01) |
| ***C21D 6/00*** | (2006.01) |
| ***C21D 8/00*** | (2006.01) |
| ***C22C 38/42*** | (2006.01) |
| ***C22C 38/54*** | (2006.01) |

(52) U.S. Cl.

CPC ..... *C21D 6/005* (2013.01); *C21D 6/008* (2013.01); *C21D 8/005* (2013.01); *C21D 9/46* (2013.01); *C22C 38/001* (2013.01); *C22C 38/004* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C25F 1/00* (2013.01); *C21D 2211/004* (2013.01); *C21D 2211/005* (2013.01)

(56) References Cited

FOREIGN PATENT DOCUMENTS

| | | |
|---|---|---|
| CN | 1511196 | 7/2004 |
| EP | 2341160 | 7/2011 |
| EP | 2799577 | 11/2014 |
| JP | 5521102 | 6/1980 |
| JP | 62146300 | 7/1987 |
| JP | 2000212704 | 8/2000 |
| JP | 2007270290 | 10/2007 |
| JP | 2007302995 | 11/2007 |
| JP | 2010065279 | 3/2010 |
| JP | 2013209706 | 10/2013 |
| WO | 2013080526 | 6/2013 |
| WO | WO2013099132 | 7/2013 |

OTHER PUBLICATIONS

Written Opinion of the International Searching Authority for International Application No. PCT/JP2013/006231 dated Jan. 28, 2014.
International Preliminary Report on Patentability for International Application No. PCT/JP2013/006231 dated Apr. 28, 2015.
Chinese Office Action for Application No. 201380055240.5 dated Jan. 26, 2016, with partial translation attached.
Extended European Search Report dated Mar. 15, 2016 for EP Application No. 13849239.2.
European Communication for European Application No. 13 849 239.2, dated Jan. 31, 2017, 3 pages.
International Search Report for International Application No. PCT/JP2013/006231 dated Jan. 28, 2014.

* cited by examiner

FERRITIC STAINLESS STEEL AND METHOD FOR MANUFACTURING THE SAME

CROSS REFERENCE TO RELATED APPLICATIONS

This is the U.S. National Phase application of PCT/JP2013/006231, filed Oct. 22, 2013, which claims priority to Japanese Patent Application No. 2012-232506, filed Oct. 22, 2012, 2013-038202, filed Feb. 28, 2013, and 2013-046247, filed Mar. 8, 2013, the disclosures of each of these applications being incorporated herein by reference in their entireties for all purposes.

FIELD OF THE INVENTION

A ferritic stainless steel according to the present invention has an excellent corrosion resistance and an excellent removal performance for a temper color. The present invention relates to an optimum ferritic stainless steel for the application to use after removing the temper color (for example, a can body for hot-water in an electric water heater and the like), which is generated in a welded portion, with an acid treatment or an electrolytic treatment and relates to a method for manufacturing the ferritic stainless steel.

BACKGROUND OF THE INVENTION

A ferritic stainless steel is used for a can body for hot-water in an electric water heater or the like because the ferritic stainless steel has no risk of stress corrosion cracking. This can body is typically assembled by tungsten inert gas welding (TIG welding). In TIG welding, the formation of an oxide film, referred to as a temper color, on the surface of the stainless steel sometimes deteriorate the corrosion resistance. Moreover, the generation of a Cr depletion region which is caused by the invasion of nitrogen in a weld bead sometimes deteriorate the corrosion resistance (this phenomenon is referred to as sensitization). Therefore, to reduce the formation of the temper color or the sensitization during welding procedure, it is recommended to perform gas shielding using Ar gas over both face and back surfaces of the welded portion.

However, in recent years, an increase in complication of the can body structure increases the welded portion where the gas shielding cannot be sufficiently performed.

In the application of the steel exposed to a severe corrosion environment, for example, the inner surface of a can body for hot-water in an electric water heater, a temper color formed in a welded portion owing to insufficient gas shielding is generally removed by a posttreatment such as an acid treatment and an electrolytic treatment.

However, the more frequent use of a stainless steel which is more excellent in the corrosion resistance than that of the conventional stainless steel for the can body increases the load of the posttreatment. In particular, it is difficult to remove the temper color generated in a weld heat-affected zone. Thus, it is required to improve the removal performance for the temper color in order to reduce the load of the posttreatment.

Patent Literature 1 discloses the technique that stabilizes C and N, which causes the sensitization, by adding Ti and Nb in order to prevent the sensitization of the welded portion.

Patent Literature 2 discloses the technique that uses the component composition satisfying Cr (mass %)+3.3Mo (mass %)≥22.0 and 4Al (mass %)+Ti (mass %) 0.32 in order to improve the corrosion resistance of the welded portion. Patent Literature 3 discloses the technique where a large amount of Cr is contained or Ni and Cu are contained in addition to Cr in order to improve the corrosion resistance of the welded portion on the side of a penetration bead which is formed by TIG welding without back gas shielding.

PATENT LITERATURE

PTL 1: Japanese Examined Patent Publication No. 55-21102

PTL 2: Japanese Unexamined Patent Application Publication No. 2007-270290

PTL 3: Japanese Unexamined Patent Application Publication No. 2007-302995

SUMMARY OF THE INVENTION

However, in Patent Literature 1, the removal performance for the temper color is deteriorated owing to the concentration of Nb in the temper color. Accordingly, there is a problem that increases the load of the acid treatment or the electrolytic treatment.

On the other hand, in Patent Literature 2 and Patent Literature 3, while the corrosion resistance of the temper color is improved, the removal performance for the temper color is deteriorated. Accordingly, the processes are not appropriate for performing the posttreatment of the welded portion. That is, the processes described in Patent Literatures 2 and 3 cannot ensure both a corrosion resistance at a certain level or more and a desired removal performance for a temper color.

In view of the problems described above in the conventional technique, objects of the present invention are to provide a ferritic stainless steel that has an excellent corrosion resistance and an excellent removal performance for a temper color and to provide a method for manufacturing the ferritic stainless steel.

The present inventors conducted exhaustive experimentations and investigations on the influence of various additive elements on the removal performance for the temper color in order to solve the problems described above.

Specifically, the following experimentation was carried out. Firstly, while Cr was set to 23 mass % and Mo was set to 1.0 mass % as reference, steel ingots containing various additive elements with different contents were prepared by melting. These steel ingots were hot-rolled, annealed and pickled, and cold-rolled to make cold-rolled sheets. Furthermore, the cold-rolled sheets were annealed and pickled under their respective optimal conditions to make cold-rolled, annealed and pickled steel sheets. These cold-rolled, annealed and pickled steel sheets were welded by TIG welding and electrolytically treated using a phosphoric acid solution at a concentration of 10 mass % after the welding. Then, the removal performance for the temper color was evaluated. As a result, the present inventors obtained the following knowledge.

(1) Concentration of Al, Si, Nb or V in a temper color of a welded portion deteriorates the removal performance for the temper color by an electrolytic treatment.

(2) Dispersion of TiN having a grain diameter of 1 μm or more on the surface of the cold-rolled, annealed and pickled steel sheet improves the removal performance for the temper color.

Then, the present inventors found that an excellent corrosion resistance was provided only in the case where the component composition or the like is in a specific range when the removal performance for the temper color was improved on the basis of the knowledge described above, and thus completed the present invention. The subject matter of the present invention includes the following aspects.

(1) A ferritic stainless steel having a composition containing, by mass %, C: 0.001% to 0.030%, Si: 0.03% to 0.30%, P: 0.05% or less, S: 0.01% or less, Cr: more than 22.0% to 28.0%, Mo: 0.2% to 3.0%, Al: 0.01% to 0.15%, Ti: more than 0.30% to 0.80%, V: 0.001% to 0.080%, and N: 0.001% to 0.050%; further Mn: 0.05% to 0.30% and Ni: 0.01% to 5.00%, or Mn: 0.05% to 2.00% and Ni: 0.01% to 0.30%; furthermore Nb: 0.050% or less as an optional component; and the balance being Fe and inevitable impurities, and the steel has a surface where TiN having a grain diameter of 1 μm or more is distributed at a density of 30 particles/$mm^2$ or more.

(2) The ferritic stainless steel according to (1), wherein the Mn content is 0.05% to 0.30%, and the Ni content is 0.01% to less than 0.30%.

(3) The ferritic stainless steel according to (1) or (2), wherein the Nb is contained as an essential component, and the Nb content is 0.001% to 0.050% by mass %, and NbN is precipitated on a surface of TiN having a grain diameter of 1 μm or more.

(4) The ferritic stainless steel according to (1), wherein, by mass %, the Mn content is 0.05% to 0.30%, the Ni content is 0.30% to 5.00%, the N content is 0.005% to 0.030%, and the Nb is contained as an essential component, and the Nb content is less than 0.05%.

(5) The ferritic stainless steel according to (1), wherein, by mass %, the Mn content is more than 0.30% to 2.00%, the Ni content is 0.01% to less than 0.30%, the S content is 0.005% or less, the N content is 0.001% to 0.030%, and the Nb is contained as an essential component, and the Nb content is less than 0.05%.

(6) The ferritic stainless steel according to (5), wherein [Mn] as the Mn content and [Si] as the Si content satisfy a formula (I) below.

$$[Mn]/[Si] \geq 2.0 \quad (I)$$

(7) The ferritic stainless steel according to any one of (1) to (6), the steel having a chemical composition further containing one or more components selected from the group consisting of, by mass %, Cu: 1.0% or less, Zr: 1.0% or less, W: 1.0% or less, and B: 0.1% or less.

(8) A method for manufacturing a ferritic stainless steel, comprising: cold rolling and annealing a steel having a component composition according to any of (1) to (7); and subsequently pickling the steel for a pickling weight loss of 0.5 g/$m^2$ or more.

The present invention allows obtaining a ferritic stainless steel having an excellent corrosion resistance and an excellent removal performance for a temper color.

DETAILED DESCRIPTION OF EMBODIMENTS OF THE INVENTION

Figure 1:
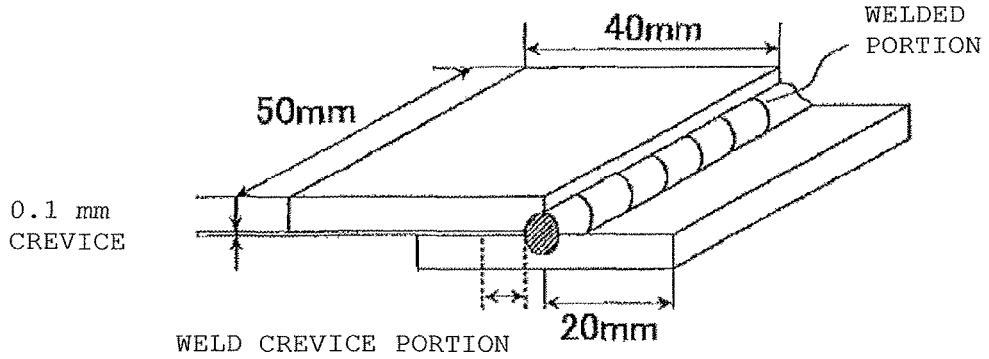
FIG. 1 is a diagram describing a shape of a lapped test piece.

The embodiments according to the present invention will be described hereafter.

A ferritic stainless steel according to and embodiment of the present invention has a composition containing, by mass %, C: 0.001% to 0.030%, Si: 0.03% to 0.30%, P: 0.05% or less, S: 0.01% or less, Cr: more than 22.0% to 28.0%, Mo: 0.2% to 3.0%, Al: 0.01% to 0.15%, Ti: more than 0.30% to 0.80%, V: 0.001% to 0.080%, and N: 0.001% to 0.050%; further containing Mn: 0.05% to 0.30% and Ni: 0.01% to 5.00%, or Mn: 0.05% to 2.00% and Ni: 0.01% to 0.30%; furthermore containing Nb: 0.050% or less as an optional component; and the balance being Fe and inevitable impurities. The steel has a surface where TiN having a grain diameter of 1 μm or more is distributed at a density of 30 particles/$mm^2$ or more.

The above-described ferritic stainless steel according to an embodiment of the present invention has an excellent corrosion resistance and an excellent removal performance for a temper color.

The component composition of the ferritic stainless steel according to embodiments of the present invention will be described. Here, "%" used when describing a content of a component means "mass %."

C: 0.001% to 0.030%

A high C content improves the strength while a low C content improves the workability. To obtain a sufficient strength, the C content is confined to be 0.001% or more. However, at a C content exceeding 0.030%, the workability is deteriorated significantly and the corrosion resistance tends to be deteriorated owing to a local depletion of Cr which is generated by the precipitation of Cr carbide. It is preferable that the C content is as low as possible, also for preventing sensitization of the welded portion. Therefore, the C content is confined to be in the range from 0.001% to 0.030%.

Si: 0.03% to 0.30%

Si is a chemical element effective for deoxidation. This effect can be obtained by setting a Si content of 0.03% or more. However, at a Si content exceeding 0.30%, the removal performance for the temper color is deteriorated because a Si oxide that is chemically extremely stable is formed in the temper color of the welded portion. Therefore, the Si content is confined to be in the range from 0.03% to 0.30%.

P: 0.05% or less

P is a chemical element which is inevitably contained in steel. An increase in P content deteriorates the weldability and is likely to cause intergranular corrosion. Therefore, the P content is confined to be 0.05% or less.

S: 0.01% or less

S is a chemical element which is inevitably contained in steel. At a S content exceeding 0.01%, the corrosion resistance is deteriorated owing to the formation of a water-soluble sulfide such as CaS and MnS. Therefore, the S content is confined to be 0.01% or less.

Cr: More than 22.0% and 28.0% or Less

Cr is a chemical element which is the most important for ensuring the corrosion resistance of the ferritic stainless steel. At a Cr content less than 22.0%, a sufficient corrosion resistance cannot be obtained in a welded portion where Cr in the surface layer is reduced by oxidation due to welding and in a Cr depletion region at the periphery of NbN precipitate containing Cr. On the other hand, at a Cr content exceeding 28.0%, the workability and the manufacturability are deteriorated. Therefore, the Cr content is confined to be in the range of more than 22.0% and 28.0% or less.

Mo: 0.2% to 3.0%

Mo promotes repassivation of a passivation film, so that the corrosion resistance of the ferritic stainless steel is improved. This effect can be obtained by setting a Mo content of 0.2% or more. However, at a Mo content exceeding 3.0%, the manufacturability is deteriorated because a rolling load is increased by an increase in strength. Therefore, the Mo content is confined to be in the range from 0.2% to 3.0%.

Al: 0.01% to 0.15%

Al is a chemical element effective for deoxidation. This effect can be obtained by containing Al in a content of 0.01% or more. However, at an Al content exceeding 0.15%, the removal of the temper color becomes difficult. Therefore, the Al content is confined to be in the range from 0.01% to 0.15%.

Ti: More than 0.30% and 0.80% or Less

Ti combines preferentially with C and N, so that the deterioration in the corrosion resistance due to the precipitation of Cr carbonitride is inhibited. This effect can be obtained with a Ti content of more than 0.30%. However, at a Ti content exceeding 0.80%, the workability is deteriorated. Therefore, the Ti content is confined to be in the range of more than 0.30% and 0.80% or less.

V: 0.001% to 0.080%

V improves the corrosion resistance. This effect can be obtained by setting a V content of 0.001% or more. However, at a V content exceeding 0.080% the removal performance for the temper color is deteriorated. Therefore, the V content is confined to be in the range from 0.001% to 0.080%.

N: 0.001% to 0.050%

N has an effect that increases the strength of steel by solid solution strengthening. Further, in the present invention, since N causes precipitation of TiN, or further NbN also in the case of steel containing Nb, the removal performance for the temper color is increased. This effect can be obtained with a N content of 0.001% or more. However, at a N content exceeding 0.050%, the corrosion resistance is deteriorated because N combines with not only Ti or Nb but also Cr and Cr nitride precipitates. Therefore, the N content is confined to be in the range from 0.001% to 0.050%.

Containing Mn: 0.05% to 0.30% and Ni: 0.01% to 5.00%, or containing Mn: 0.05% to 2.00% and Ni: 0.01% to 0.30%

By containing Mn in a content of 0.05% to 0.30% and Ni in a content of 0.01% to 5.00% or containing Mn in a content of 0.05% to 2.00% and Ni in a content of 0.01% to 0.30%, the ferritic stainless steel according to embodiments of the present invention has an excellent or significantly excellent corrosion resistance and also has an excellent or significantly excellent removal performance for the temper color.

The balance other than the above-described components is Fe and inevitable impurities. It is preferable that the ferritic stainless steel according to the present invention contain Nb in a content of 0.050% or less as an optional component.

Nb: 0.050% or Less

It is preferable that a small amount of Nb be contained because the removal performance for the temper color is further increased. To obtain the above-described effect, it is preferable that the Nb content be 0.001% or more. However, in contrast, at a Nb content exceeding 0.050%, the removal performance for the temper color is deteriorated markedly. Therefore, it is preferable that the Nb content is 0.050% or less.

From the viewpoints of improving the corrosion resistance and improving the workability, the ferritic stainless steel according to the present invention may contain one or more components selected from the group consisting of Cu, Zr, W, and B as a selected chemical element in the following ranges.

Cu: 1.0% or Less

Cu improves the corrosion resistance of the stainless steel. To obtain this effect, it is preferable that the Cu content is 0.01% or more. However, at an excessive Cu content, the corrosion resistance is deteriorated because the passive current increases and the passivation film becomes unstable. Therefore, it is preferable that the Cu content be 1.0% or less in the case where Cu is contained.

Zr: 1.0% or Less

Zr combines with C and N, so that the sensitization of the weld bead is reduced. To obtain this effect, it is preferable that the Zr content is 0.01% or more. However, at an excessive Zr content, the workability is deteriorated and a cost increase since Zr is a considerably expensive chemical element. Therefore, it is preferable that the Zr content be 1.0% or less in the case where Zr is contained.

W: 1.0% or Less

W improves the corrosion resistance similarly to Mo. To obtain this effect, it is preferable that the W content is 0.01% or more. However, at an excessive W content, the manufacturability is deteriorated because a rolling load is increased by an increase in the strength. Therefore, it is preferable that the W content is 1.0% or less in the case where W is contained.

B: 0.1% or Less

B improves the secondary working brittleness resistance. To obtain this effect, it is preferable that the B content is 0.0001% or more. However, at an excessive B content, the ductility is deteriorated owing to solid solution strengthening. Therefore, it is preferable that the B content is 0.1% or less in the case where B is contained.

Density Distribution of TiN Having the Grain Diameter of 1 μm or More on the Surface of the Steel: 30 Particles/$Mm^2$ or More The temper color is removed typically by an acid treatment or an electrolytic treatment. The temper color is formed of the oxides of chemical elements such as Si, Al, and Cr. These oxides are stable to acid and electric potential compared with base iron and less likely to be dissolved. Therefore, the removal of the temper color by an acid treatment, an electrolytic treatment, or the like is performed by dissolving the Cr depletion region just under the temper color and peeling off the temper color. At this time, when the temper color uniformly and densely protects the surface of the base iron, an acid or an electrolytic solution does not reach the Cr depletion region. This deteriorates the removal performance for the temper color.

The thickness of the temper color is generally several hundred nm. In the case where a coarse TiN particle having a grain diameter of 1 μm or more exists on the surface, the TiN exists while breaking through the temper color. Therefore, the peripheral area of the TiN becomes a defect of the temper color. Since an acid or an electrolytic solution penetrates into the base iron through this area, the removal performance for the temper color is improved. An improvement in the removal performance for the temper color can be obtained by distribution of TiN having a grain diameter of 1 μm or more at a density of 30 particles/$mm^2$ or more on the surface of the temper color.

Subsequently, an exemplary method for manufacturing the ferritic stainless steel according to the present invention will be described. It is preferable that the ferritic stainless steel according to the present invention is manufactured by the following method. The stainless steel ingot having the above-described chemical composition is heated and then hot-rolled into a hot-rolled steel sheet. This hot-rolled sheet is annealed and pickled. Subsequently, the sheet is cold-rolled, and is annealed and pickled.

The above-described ferritic stainless steel according to the present invention is excellent in the corrosion resistance and the removal performance for the temper color. In particular, the stainless steel according to a first embodiment below corresponds to the ferritic stainless steels according to Claims 2 and 3, and has a feature that it has a significantly excellent corrosion resistance and an excellent workability. The stainless steel according to a second embodiment below corresponds to the ferritic stainless steel according to Claim 4, and has a feature that it is significantly excellent in the corrosion resistance and the removal performance for the temper color and also excellent in the corrosion resistance in a weld crevice portion. The stainless steel according to a third embodiment below corresponds to the ferritic stainless steels according to Claims 5 and 6, and has a feature that it shows a significantly excellent temper-color removal performance.

The stainless steel sheets according to the present invention will be described hereafter in reference to the respective embodiments as examples.

First Embodiment

1. Regarding a Component Composition

The ferritic stainless steel according to the first embodiment has a composition containing, by mass %, C: 0.001% to 0.030%, Si: 0.03% to 0.30%, P: 0.05% or less, S: 0.01% or less, Cr: more than 22.0% to 28.0%, Mo: 0.2% to 3.0%, Al: 0.01% to 0.15%, Ti: more than 0.30% to 0.80%, V: 0.001% to 0.080%, N: 0.001% to 0.050%, Mn: 0.05% to 0.30%, Ni: 0.01% or more and less than 0.30%, Nb: 0.001% to 0.050% or less as an optional component, and the balance being Fe and inevitable impurities. Here, % used below when describing a component also means mass % (the same applies to the other embodiments).

C: 0.001% to 0.030%

A high C content improves the strength while a low C content improves the workability. To obtain a sufficient strength, the C content is confined to be 0.001% or more. However, at a C content exceeding 0.030%, the workability is deteriorated significantly and the corrosion resistance tends to be deteriorated due to a local depletion of Cr which is generated by the precipitation of Cr carbide. It is preferable that the C content is as small as possible, also for preventing sensitization of the welded portion. Therefore, the C content is confined to be in the range from 0.001% to 0.030%, preferably in the range from 0.002% to 0.018%, more preferably in the range from 0.002% to 0.012%.

Si: 0.03% to 0.30%

Si is a chemical element effective for deoxidation. This effect can be obtained by setting a Si content of 0.03% or more. However, at a Si content exceeding 0.30%, the removal performance for the temper color is deteriorated because a Si oxide that is chemically extremely stable is formed in the temper color of the welded portion. Therefore, the Si content is confined to be in the range from 0.03% to 0.30%, preferably in the range from 0.05% to 0.15%.

Mn: 0.05% to 0.30%

Mn has an effect that enhances the strength of steel. This effect can be obtained by setting a Mn content of 0.05% or more. However, at an excessive Mn content, the corrosion resistance is deteriorated owing to the promotion of precipitation of MnS from which corrosion starts. Therefore, the Mn content is confined to be 0.30% or less. Keeping a small Mn content as just described allows providing a significantly excellent corrosion resistance to the ferritic stainless steel. As described above, the Mn content is confined to be in the range from 0.05% to 0.30%, preferably in the range from 0.08% to 0.25%, more preferably in the range from 0.08% to 0.20%.

P: 0.05% or Less

P is a chemical element which is inevitably contained in steel. An increase in P content deteriorates the weldability and is likely to cause intergranular corrosion. Therefore, the P content is confined to be 0.05% or less, preferably 0.03% or less.

S: 0.01% or Less

S is a chemical element which is inevitably contained in steel. At a S content exceeding 0.01%, the corrosion resistance is deteriorated owing to the formation of a water-soluble sulfide such as CaS and MnS. Like this embodiment, the Mn content in the range from 0.05% to 0.30% and the like allow sufficiently inhibiting the deterioration in the corrosion resistance even when the S content is in the range of more than 0.005% and 0.01% or less. Therefore, the S content is confined to be 0.01% or less, preferably 0.006% or less.

Cr: More than 22.0% and 28.0% or Less

Cr is a chemical element which is the most important for ensuring the corrosion resistance of the ferritic stainless steel. Especially in this embodiment, it is one of the features that Cr allows providing an excellent corrosion resistance to the ferritic stainless steel through optimization of the Mn amount or the like. For example, the ferritic stainless steel according to this embodiment can be used even in the application in a severe corrosion environment where the water quality is poor or the like. To provide a significantly excellent corrosion resistance, the Cr content is confined to be more than 22.0%. At a Cr content of 22.0% or less, a sufficient corrosion resistance cannot be obtained in a welded portion where Cr in the surface layer is reduced by oxidation due to welding and in a Cr depletion region at the periphery of NbN precipitate containing Cr. On the other hand, at a Cr content exceeding 28.0%, the workability and the manufacturability are deteriorated. Moreover, at a Cr content exceeding 28.0%, the removal performance for the temper color is deteriorated rapidly. Therefore, the Cr content is confined to be in the range of more than 22.0% and 28.0% or less, preferably in the range from 22.3% to 26.0%, more preferably in the range from 22.3% to 24.5%.

Ni: 0.01% or More and Less than 0.30%

Ni improves the corrosion resistance of the stainless steel. In particular, Ni inhibits the progress of corrosion in the corrosion environment where a passivation film cannot be formed and active dissolution occurs. This effect can be obtained by setting a Ni content of 0.01% or more. However, at a Ni content of 0.30% or more, a cost increases since Ni is an expensive chemical element in addition to deterioration in the workability. The work into a can body in a complicated shape requires an excellent workability. Thus, in the ferritic stainless steel according to this embodiment, the workability is improved by setting a Ni content of less than 0.30%. Therefore, the Ni amount is confined to be in the range of 0.01% or more and less than 0.30%, preferably in the range from 0.03% to 0.24%.

Mo: 0.2% to 3.0%

Mo promotes repassivation of a passivation film, so that the corrosion resistance of the ferritic stainless steel is improved. This effect can be obtained by setting a Mo content of 0.2% or more. However, at a Mo content exceeding 3.0%, the manufacturability is deteriorated because a rolling load is increased by an increase in the strength. Therefore, the Mo content is confined to be in the range from 0.2% to 3.0%, preferably in the range from 0.6% to 2.4%, more preferably in the range from 0.8% to 1.8%.

Al: 0.01% to 0.15%

Al is a chemical element effective for deoxidation. This effect can be obtained by containing Al in a content of 0.01% or more. However, since Al is concentrated in the temper color of the welded portion, the removal performance for the temper color is deteriorated. At an Al content exceeding 0.15%, the removal of the temper color becomes difficult. Therefore, the Al content is confined to be in the range from 0.01% to 0.15%, preferably in the range from 0.015% to 0.08%, more preferably in the range from 0.02% to 0.05%.

Ti: More than 0.30% and 0.80% or Less

Ti combines preferentially with C and N, so that the deterioration in the corrosion resistance due to the precipitation of Cr carbonitride is inhibited. Further, in this embodiment, Ti is an important chemical element to reduce the sensitization of the weld bead by combining with N which has invaded in the weld bead through a shielding gas. Furthermore, Ti improves the removal performance for the temper color by dispersing TiN on the surface of the steel. This effect can be obtained with a Ti content of more than 0.30%. However, at a Ti content exceeding 0.80%, the workability is deteriorated. In this embodiment, the workability is improved with consideration of the Ni content and the ferritic stainless steel according to this embodiment has an excellent workability as one of the features. To achieve this excellent workability, the Ti content is confined to be less than 0.80%. Therefore, the Ti content is in the range of more than 0.30% and 0.80% or less, preferably in the range from 0.32% to 0.60%, more preferably in the range from 0.33% to 0.50%.

V: 0.001% to 0.080%

V improves the corrosion resistance. This effect can be obtained by setting a V content of 0.001% or more. However, at a V content exceeding 0.080%, the removal performance for the temper color is deteriorated. Therefore, the V content is confined to be in the range from 0.001% to 0.080%, preferably in the range from 0.002% to 0.060%, more preferably in the range from 0.005% to 0.040%.

N: 0.001% to 0.050%

N has an effect that increases the strength of steel by solid solution strengthening. Further, in this application, N is also a chemical element that improves the removal performance for the temper color by precipitating TiN or further NbN in the case of steel containing Nb. This effect can be obtained with a N content of 0.001% or more. However, at a N content exceeding 0.050%, the corrosion resistance is deteriorated because N combines with not only Ti or Nb but also Cr and Cr nitride precipitates. Therefore, the N content is confined to be 0.050% or less. As described above, the N content is confined to be in the range from 0.001% to 0.050%, preferably in the range from 0.002% to 0.025%, more preferably in the range from 0.002% to 0.018%.

Density Distribution of TiN Having the Grain Diameter of 1 μm or More on the Surface of the Steel: 30 Particles/mm$^2$ or More The temper color is removed typically by an acid treatment or an electrolytic treatment. The temper color is formed of the oxides of chemical elements such as Si, Al, and Cr. These oxides are stable to acid and electric potential compared with base iron and less likely to be dissolved. Therefore, the removal of the temper color by an acid treatment, an electrolytic treatment, or the like is performed by dissolving the Cr depletion region just under the temper color and peeling off the temper color. At this time, when the temper color uniformly and densely protects the surface of the base iron, an acid or an electrolytic solution does not reach the Cr depletion region. This deteriorates the removal performance for the temper color.

The thickness of the temper color is generally several hundred nm. In the case where a coarse TiN particle having a grain diameter of 1 μm or more exists on the surface, the TiN exists while breaking through the temper color. Therefore, the peripheral area of the TiN becomes a defect of the temper color. Since an acid or an electrolytic solution penetrates into the base iron through this area, the removal performance for the temper color is improved. An improvement in the removal performance for the temper color can be obtained by distribution of TiN having a grain diameter of 1 μm or more at a density of 30 particles/mm$^2$ or more on the surface of the temper color. Preferably, TiN is distributed at a density of 35 particles/mm$^2$ or more to 150 particles/mm$^2$.

The basic chemical components of the ferritic stainless steel according to this embodiment are as described above and the balance is Fe and inevitable impurities. Further, the ferritic stainless steel according to the present invention may contain Nb in the following range.

Nb: 0.001% to 0.050% or Less

Nb combines preferentially with C and N, so that the deterioration in the corrosion resistance due to the precipitation of Cr carbonitride is inhibited. Furthermore, a small content of Nb being contained causes precipitation of NbN attaching to a TiN-precipitation portion. When NbN is precipitated, NbN is precipitated in complex with Cr (Cr is incorporated into NbN). Therefore, a small Cr depletion region to the extent that does not affect the corrosion resistance is formed in the peripheral area of the TiN-precipitation portion. The temper color is likely to be removed as the base iron has a smaller Cr content. Accordingly, the temper color formed in the peripheral area of TiN to which NbN is attached is likely to be removed due to the low Cr content in the base iron. These effects can be obtained with an Nb content of 0.001% or more. However, at a Nb content exceeding 0.050%, the removal performance for the temper color is deteriorated considerably owing to the concentration of Nb in the temper color. Therefore, it is preferable that the Nb content is in the range from 0.001% to 0.050%, more preferably in the range from 0.002% to 0.008%.

NbN is precipitated while being attached to TiN of 1 μm or more

As described above, containing a small amount of Nb is more likely to cause the removal of the temper color at the periphery of TiN. In this embodiment, while an excellent removal performance for the temper color can be achieved without containing Nb, containing a trace of Nb allows providing a more excellent removal performance for the temper color to the ferritic stainless steel. NbN is precipitated on the surface of TiN as a nucleation site and a preferable thickness of NbN is from 5 to 50 nm. In the composition range according to an embodiment of the present invention, NbN contains Cr. To improve the removal performance for the temper color, it is preferable that a ratio Cr/Nb between Cr and Nb contained in NbN be in the range from 0.05 to 0.50.

Further, from the viewpoints of improving the corrosion resistance and improving the workability, the ferritic stainless steel may contain one or more components selected from the group consisting of Cu, Zr, W, and B as a selected chemical element in the following ranges.

Cu: 1.0% or Less

Cu improves the corrosion resistance of a stainless steel. To obtain this effect, it is preferable that the Cu content is 0.01% or more. However, at an excessive Cu content, the corrosion resistance is deteriorated because the passive current increases and the passivation film becomes unstable. Therefore, it is preferable that the Cu content be 1.0% or less in the case where Cu is contained. A more preferable Cu content is 0.6% or less.

Zr: 1.0% or Less

Zr combines with C and N, so that the sensitization of the weld bead is reduced. To obtain this effect, it is preferable that the Zr content is 0.01% or more. However, at an excessive Zr content, the workability is deteriorated and a cost increase since Zr is a considerably expensive chemical element. Therefore, it is preferable that the Zr content is 1.0% or less in the case where Zr is contained. A more preferable Zr content is 0.6% or less, further more preferably 0.2% or less.

W: 1.0% or less

A more preferable W content is 0.6% or less, further more preferably 0.2% or less.

W improves the corrosion resistance similarly to Mo. To obtain this effect, it is preferable that the W content is 0.01% or more. However, at an excessive W content, the manufacturability is deteriorated because a rolling load is increased by an increase in the strength. Therefore, it is preferable that the W content is 1.0% or less in the case where W is contained. A more preferable W content is 0.6% or less, further more preferably 0.2% or less.

B: 0.1% or Less

B improves the secondary working brittleness resistance. To obtain this effect, it is preferable that the B content is 0.0001% or more. However, at an excessive B content, the ductility is deteriorated owing to solid solution strengthening. Therefore, it is preferable that the B content is 0.1% or less in the case where B is contained. A more preferable B content is 0.005% or less, further more preferably 0.002% or less.

2. Property of the Ferritic Stainless Steel According to the First Embodiment

In common with the second embodiment and the third embodiment, the ferritic stainless steel according to the first embodiment has a corrosion resistance at a certain level or more and a removal performance for the temper color at a certain level or more.

The ferritic stainless steel according to the first embodiment has a significantly excellent corrosion resistance and an excellent workability since the Mn content is 0.05% to 0.30% and the Ni content is 0.01% to less than 0.30% in the component composition according to the first embodiment.

3. A Method for Manufacturing the Ferritic Stainless Steel According to the First Embodiment Next, a method for manufacturing the ferritic stainless steel according to this embodiment will be described.

The stainless steel having the above-described chemical composition is heated from 1100° C. to 1300° C. and then hot-rolled at a finishing temperature from 700° C. to 1000° C. and a coiling temperature from 500° C. to 900° C. to have a sheet thickness from 2.0 mm to 5.0 mm. The hot-rolled steel sheet thus prepared is annealed at a temperature from 800° C. to 1000° C., pickled, and then cold-rolled into a cold-rolled sheet, subjected to annealing at a temperature from 800° C. to 900° C. for a duration of 1 min or more. To inhibit the recovery of the Cr depletion region at the periphery of TiN, the cooling rate after the annealing of the cold-rolled sheet is set to 5° C./s or more until 500° C., more preferably 10° C./s or more.

The cold-rolled sheet after the annealing is cooled and then pickled such that the steel sheet surface is removed by pickling weight loss of 0.5 g/m$^2$ or more and by thickness of 0.05 μm or more from both surfaces to cause the appearance of TiN on the steel sheet surface. This pickling causes TiN on the steel sheet surface at 30 particles/mm$^2$ or more. Pickling methods include acid dipping such as pickling by sulfuric acid, pickling by nitric acid, and pickling by nitric hydrofluoric acid and/or electrolytic pickling such as electrolytic pickling by neutral salt and electrolytic pickling by nitrohydrochloric acid. These pickling methods may be combined together. A method other than pickling may be used to cause the appearance of TiN on the steel sheet surface.

Second Embodiment

1. Regarding a Component Composition

The ferritic stainless steel according to the second embodiment has a composition containing, by mass %, C: 0.001% to 0.030%, Si: 0.03% to 0.30%, P: 0.05% or less, S: 0.01% or less, Cr: more than 22.0% to 28.0%, Mo: 0.2% to 3.0%, Al: 0.01% to 0.15%, Ti: more than 0.30% to 0.80%, V: 0.001% to 0.080%, Mn: 0.05% to 0.30%, Ni: 0.30% to 5.00%, N: 0.005% to 0.030%, Nb: less than 0.050%, and the balance being Fe and inevitable impurities.

C: 0.001% to 0.030%

A high C content improves the strength while a low C content improves the workability. To obtain a sufficient strength, the C content is confined to be 0.001% or more. However, at a C content exceeding 0.030%, the workability is deteriorated significantly and the corrosion resistance tends to be deteriorated owing to a local depletion of Cr which is generated by the precipitation of Cr carbide. It is preferable that the C content is as small as possible, also for preventing sensitization of the welded portion. Therefore, the C content is confined to be in the range from 0.001% to 0.030%. Therefore, the C content is confined to be in the range from 0.001% to 0.030%, preferably in the range from 0.002% to 0.018%, more preferably in the range from 0.003% to 0.012%.

Si: 0.03% to 0.30%

Si is a chemical element effective for deoxidation. This effect can be obtained by setting a Si content of 0.03% or more. However, at a Si content exceeding 0.30%, the removal performance for the temper color is deteriorated because a Si oxide that is chemically extremely stable is formed in the temper color of the welded portion. Therefore, the Si content is confined to be in the range from 0.03% to 0.30%, preferably in the range from 0.05% to 0.15%.

Mn: 0.05% to 0.30%

Mn has an effect that enhances the strength of steel. This effect can be obtained by setting a Mn content of 0.05% or more. However, at an excessive Mn content, the corrosion resistance is deteriorated owing to the promotion of precipitation of MnS from which corrosion starts. Keeping a content Mn content as just described allows providing a significantly excellent corrosion resistance to the ferritic stainless steel. Therefore, the Mn content is confined to be in the range from 0.05% to 0.30%, preferably in the range from 0.08% to 0.25%, more preferably in the range from 0.08% to 0.20%.

P: 0.05% or Less

P is a chemical element which is inevitably contained in steel. An increase in P content deteriorates the weldability and is likely to cause intergranular corrosion. Therefore, the P content is confined to be 0.05% or less, preferably 0.03% or less.

S: 0.01% or Less

S is a chemical element which is inevitably contained in steel. At a S content exceeding 0.01%, the corrosion resistance is deteriorated owing to the formation of a water-soluble sulfide such as CaS and MnS. Therefore, the S content is confined to be 0.01% or less, preferably 0.004% or less.

Cr: More than 22.0% and 28.0% or Less

Cr is a chemical element which is the most important for ensuring the corrosion resistance of the ferritic stainless steel. Especially in this embodiment, it is preferable that the Cr content be as large as possible, for ensuring an excellent corrosion resistance inside a weld crevice structure. With a Cr content of 22.0% or less, a sufficient corrosion resistance cannot be obtained in a welded portion where Cr in the surface layer is reduced by oxidation due to welding and in a Cr depletion region at the periphery of NbN precipitate containing Cr. Therefore, the Cr content is confined to be more than 22.0%. On the other hand, at a Cr content exceeding 28.0%, the removal performance for the temper color is deteriorated rapidly. Then, it becomes difficult to improve the corrosion resistance by the removal of the temper color, for example, an acid treatment. The Cr content exceeding 28.0% deteriorates the workability and the manufacturability. Therefore, the Cr content is confined to be in the range of more than 22.0% and 28.0% or less, preferably in the range from 22.3% to 26.0%, more preferably in the range from 22.3% to 25.0%.

Ni: 0.30% to 5.00%

Ni improves the corrosion resistance of the ferritic stainless steel. In particular, Ni inhibits the progress of corrosion in the corrosion environment where a passivation film cannot be formed and active dissolution occurs.

Figure 2:
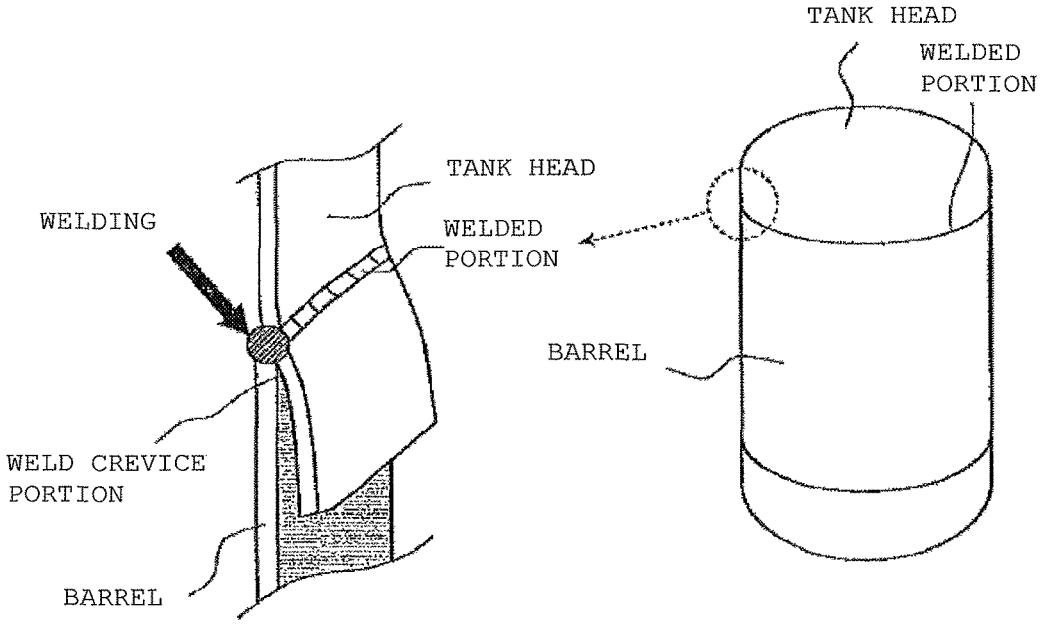
FIG. 2 is a diagram describing a shape of a welded portion between a tank head and a barrel of a can body for hot-water in an electric water heater.

Furthermore, in this embodiment, Ni is an important chemical element to improve the corrosion resistance of the weld crevice structure. There are weld crevices in some parts of a can body for hot-water in an electric water heater. For example, as illustrated in FIG. 2, the weld crevice structure is formed by a fillet welding of lap joint of a bowl-shaped part referred to as a tank head to a cylindrically-shaped member referred to as a barrel, of the can body for hot-water in the electric water heater. Here, the corrosion resistance of the weld crevice structure becomes a problem due to the following reason.

In the removal of the temper color by the acid treatment or the electrolytic treatment, the acid and the electrolytic solution dissolve the temper color and the steel just under the temper color. Excessive dissolution of the steel with this treatment causes a markedly uneven surface and form smaller crevice shapes at the inside of crevice. This causes remarkable accumulation of ions at the inside of crevice. The ions of Cr and Fe eluted from the steel are deposited as hydroxide at the inside of the small crevices and pH at the inside of crevice is reduced. As a result, the corrosion environment at the inside of crevice becomes severer.

Like this embodiment, appropriate content of Ni, which has an effect that inhibits the reduction in pH at the inside of crevice, causes inhibition of the reduction in pH due to Ni ion elution at the stage where the steel is slightly dissolved by the removal of the temper color. This stabilizes the surface profile by inhibiting the excessive dissolution of the steel. Accordingly, it is considered that the flow of solution between the inside of crevice and the outside of crevice becomes smooth and promotes the diffusion of the eluted ions to the outside of crevice, therefore the corrosion environment becomes mild. This effect can be obtained by containing Ni in a content of 0.30% or more.

However, at a Ni content exceeding 5.00%, the steel has the structure where ferrite and austenite are mixed because the generation of an austenite structure is promoted. The formation of a macrocell due to this diploidization deteriorates the corrosion resistance. Furthermore, at a Ni content exceeding 5.00%, the stress corrosion cracking, which becomes a problem in a water heater environment at a high temperature of about 80° C., is likely to occur. Therefore, the Ni content is confined to be in the range from 0.30% to 5.00%, preferably in the range from more than 2.00% to 4.00%.

Mo: 0.2% to 3.0%

Mo promotes repassivation of a passivation film, so that the corrosion resistance of the stainless steel is improved. This effect can be obtained by setting a Mo content of 0.2% or more. However, at a Mo content exceeding 3.0%, the manufacturability is deteriorated because a rolling load is increased by an increase in strength. Therefore, the Mo content is confined to be in the range from 0.2% to 3.0%, preferably in the range from 0.6% to 2.4%, more preferably in the range from 0.7% to 2.0%.

Al: 0.01% to 0.15%

Al is a chemical element effective for deoxidation. This effect can be obtained by setting an Al content of 0.01% or more. However, Al deteriorates the removal performance for the temper color because Al is concentrated in the temper color of the welded portion. At an Al content exceeding 0.15%, the removal of the temper color becomes difficult. Therefore, the Al content is confined to be in the range from 0.01% to 0.15%, preferably in the range from 0.015% to 0.08%, more preferably in the range from 0.02% to 0.06%.

Ti: More than 0.30% and 0.80% or Less

Ti combines preferentially with C and N, so that the deterioration in the corrosion resistance due to the precipitation of Cr carbonitride is inhibited. Further, in this embodiment, Ti reduces the sensitization of the weld bead by combining with N which has invaded in the weld bead through a shielding gas. Furthermore, Ti has effects that improves the corrosion resistance by strengthening the passivation film and improves the removal performance for the temper color by combining with N as TiN. These effects become remarkable when the Ti content is more than 0.30%. However, at a Ti content exceeding 0.80%, the removal performance for the temper color is deteriorated owing to the concentration of Ti in the temper color. Therefore, the Ti content is confined to be in the range of more than 0.30% and 0.80% or less, preferably in the range from 0.32% to 0.60%, more preferably in the range from 0.35% to 0.55%.

Nb: Less than 0.050%

Nb combines preferentially with C and N, so that the deterioration in the corrosion resistance due to the precipitation of Cr carbonitride is inhibited. In this embodiment, Nb deteriorates the removal performance for the temper color owing to the concentration of Nb in the vicinity of the interface between the ferritic stainless steel and the temper color formed on the surface of the ferritic stainless steel. Therefore, the Nb content is confined to be less than 0.050%. However, at a low content of Nb, the removal performance for the temper color is increased. This effect can be obtained by setting an Nb content of 0.001% or more. Therefore, it is preferable that the Nb content is confined to be in the range from 0.001% to less than 0.050%, more preferably in the range from 0.002% to 0.008%.

V: 0.001% to 0.080%

V improves the corrosion resistance. Furthermore, V is a necessary chemical element for enhancing the corrosion resistance in the weld crevice structure of the ferritic stainless steel. This effect can be obtained by containing V in a content of 0.001% or more. However, at a V content exceeding 0.080%, the removal performance for the temper color is deteriorated owing to the concentration of V along with Nb at the interface between the steel and the temper color. Therefore, the V content is confined to be in the range from 0.001% to 0.080%, preferably in the range from 0.002% to 0.060%, more preferably in the range from 0.005% to 0.050%.

N: 0.005% to 0.030%

N has an effect that increases the strength of steel by solid solution strengthening. Further, in the present invention, N is also a chemical element that improves the removal performance for the temper color by forming TiN precipitation on the surface of the steel. These effects can be obtained by setting a N content of 0.001% or more similarly to the first embodiment, but it is preferable that the N content be 0.005% or more to provide more excellent effects. However, at a N content equal to or higher than the content needed for binding to Ti, the corrosion resistance might be reduced slightly owing to the precipitation of Cr nitride by N. Therefore, to further increase the corrosion resistance, the N content is confined to be 0.030% or less. As described above, the N content is confined to be in the range from 0.005% to 0.030%, preferably in the range from 0.005% to 0.025%, more preferably in the range from 0.007% to 0.015%.

Distribution of TiN having the grain diameter of 1 μm or more on the steel surface at a density of 30 particles/mm$^2$ or more The temper color formed on the surface of the ferritic stainless steel by welding or the like is removed typically by an acid treatment or an electrolytic treatment. The temper color of the ferritic stainless steel is formed of the oxides of Si, Al, Cr, and the like. These oxides are stable to acid and electric potential compared with the steel itself and less likely to be dissolved. Therefore, the removal of the temper color by an acid treatment, an electrolytic treatment, or the like is performed by dissolution of the Cr depletion region just under the temper color and peeling off the temper color. At this time, when the temper color uniformly and densely protects the surface of the ferritic stainless steel, an acid or an electrolytic solution does not reach the Cr depletion region. This deteriorates the removal performance for the temper color.

The thickness of the temper color is generally several hundreds of nanometer. In the case where a coarse TiN particle having a grain diameter of 1 μm or more exists on the steel surface, the TiN often exists while breaking through the temper color. The peripheral area of the TiN becomes a defect of the temper color. Since an acid or an electrolytic solution penetrates into the steel itself through this area, the removal performance for the temper color is improved. Therefore, TiN having a grain diameter of 1 μm or more is confined to be distributed at a density of 30 particles/mm$^2$ or more on the surface of the temper color. Preferably, TiN is distributed at a density of 35 particles/mm$^2$ or more to 150 particles/mm$^2$.

Further, from the viewpoints of improving the corrosion resistance and improving the workability, the ferritic stainless steel according to this embodiment may contain one or more components selected from the group consisting of Cu, Zr, W, and B as a selected chemical element in the following ranges.

Cu: 1.0% or Less

Cu improves the corrosion resistance of the stainless steel. To obtain this effect, it is preferable that the Cu content is 0.01% or more. However, at an excessive Cu content, the corrosion resistance is deteriorated because the passive current increases and the passivation film becomes unstable. Therefore, it is preferable that the Cu content be 1.0% or less in the case where Cu is contained. A more preferable Cu amount is 0.6% or less.

Zr: 1.0% or less

Zr provides an effect that reduces the sensitization by combining with C and N. To obtain this effect, it is preferable that the Zr content be 0.01% or more. However, at an excessive Zr content, the workability is deteriorated and a cost increase since Zr is a considerably expensive chemical element. Therefore, it is preferable that the Zr content is 1.0% or less in the case where Zr is contained. A more preferable Zr content is 0.6% or less, further more preferably 0.2% or less.

W: 1.0% or Less

W has an effect that improves the corrosion resistance similarly to Mo. To obtain this effect, it is preferable that the W content is 0.01% or more. However, at an excessive W content the manufacturability is deteriorated because a rolling load is increased by an increase in the strength. Therefore, it is preferable that the W content is 1.0% or less in the case where W is contained. A more preferable W content is 0.6% or less, further more preferably 0.2% or less.

B: 0.1% or Less

B improves the secondary working brittleness resistance. To obtain this effect, it is preferable that the B content is 0.0001% or more. However, at an excessive B content, the ductility is deteriorated owing to solid solution strengthening. Therefore, it is preferable that the B content is 0.1% or less in the case where B is contained. A more preferable B content is 0.01% or less, further more preferably 0.005% or less.

2. Property of the Ferritic Stainless Steel According to the Second Embodiment

In common with the first embodiment and the third embodiment, the ferritic stainless steel according to the second embodiment has a corrosion resistance at a certain level or more and a removal performance for the temper color at a certain level or more.

The ferritic stainless steel according to the second embodiment has a significantly excellent crevice corrosion resistance since the Mn content is 0.05% to 0.30% and the Ni content is 0.30% to 5.00% in the component composition according to the second embodiment.

3. A Method for Manufacturing the Ferritic Stainless Steel According to the Second Embodiment Next, a method for manufacturing the ferritic stainless steel according to this embodiment will be described.

The stainless steel having the above-described chemical composition is heated from 1100° C. to 1300° C. and then hot-rolled at a finishing temperature from 700 to 1000° C. and a coiling temperature from 500 to 900° C. to have a sheet thickness from 2.0 to 5.0 mm. The hot-rolled steel sheet thus prepared is annealed at a temperature from 800 to 1000° C., pickled, and then cold-rolled into a cold-rolled sheet, subjected to annealing at a temperature from 800 to 900° C. for a duration of 30 seconds or more and pickling.

In the pickling after the annealing of the cold-rolled sheet, causing a pickling weight loss of 0.5 g/m$^2$ or more allows the appearance of TiN at 30 particles/mm$^2$ or more on the surface to improve the temper-color removal performance. Pickling methods include acid dipping such as pickling by sulfuric acid, pickling by nitric acid, and pickling by nitric hydrofluoric acid and/or electrolytic pickling such as electrolytic pickling by neutral salt and electrolytic pickling by nitrohydrochloric acid. These pickling methods may be combined together.

Third Embodiment

1. Regarding a Component Composition

The ferritic stainless steel according to the third embodiment has a composition containing, by mass %, C: 0.001% to 0.030%, Si: 0.03% to 0.30%, P: 0.05% or less, S: 0.005% or less, Cr: more than 22.0% to 28.0%, Mo: 0.2% to 3.0%, Al: 0.01% to 0.15%, Ti: more than 0.30% to 0.80%, V: 0.001% to 0.080%, Mn: more than 0.30% to 2.00%, Ni: 0.01% to less than 0.30%, N: 0.001% to 0.030%, Nb: less than 0.050%, and the balance being Fe and inevitable impurities.

1. Regarding a Component Composition

C: 0.001% to 0.030%

A high C content improves the strength while a low C content improves the workability. To obtain a sufficient strength, the C content is confined to be 0.001% or more. However, at a C content exceeding 0.030%, the workability is deteriorated significantly and the corrosion resistance tends to be deteriorated owing to a local depletion of Cr which is generated by the precipitation of Cr carbide. It is preferable that the C content is as small as possible, also for preventing sensitization of the welded portion. Therefore, the C content is confined to be in the range from 0.001% to 0.030%, preferably in the range from 0.002% to 0.018%, more preferably in the range from 0.002% to 0.012%.

Si: 0.03% to 0.30%

Si is a chemical element effective for deoxidation. This effect can be obtained by setting a Si content of 0.03% or more. However, at a Si content exceeding 0.30%, the removal performance for the temper color is deteriorated because a Si oxide that is chemically extremely stable is formed in the temper color of the welded portion. Therefore, the Si content is confined to be in the range from 0.03% to 0.30%, preferably in the range from 0.05% to 0.15%, more preferably in the range from 0.07% to 0.13%.

Mn: More than 0.30% and 2.00% or Less

Mn is a chemical element which enhances the removal performance for the temper color by concentrating in the temper color. Mn is concentrated as a form of oxide in the temper color of the ferritic stainless steel together with Cr, Si, and Al. Unlike the Si oxide or the like, the Mn oxide has a property that is easily dissolved as a manganese ion in an acid solution or a permanganate ion in a high electric potential environment. Therefore, when the temper color containing a large amount of Mn is removed by an acid treatment or an electrolytic treatment, the Mn oxide is dissolved and the penetration of the acid or the electrolytic solution into the steel is facilitated. As a result, a high Mn content facilitates the removal of the temper color. As just described, the ferritic stainless steel according to this embodiment has a significantly excellent removal performance for the temper color. The effect to improve the removal performance for the temper color can be obtained with the Mn content of more than 0.30% in the steel. However, at a Mn content exceeding 2.00%, the hot workability is deteriorated owing to an increase in the rolling load. Therefore, the Mn content is confined to be in the range of more than 0.30% and 2.00% or less, preferably in the range from 0.35% to 1.20%, more preferably in the range from 0.36% to 0.70%.

P: 0.05% or Less

P is a chemical element which is inevitably contained in steel. An increase in P content deteriorates the weldability and is likely to cause intergranular corrosion. Therefore, the P content is confined to be 0.05% or less, preferably 0.04% or less, more preferably 0.03% or less.

S: 0.005% or Less

S is a chemical element which is inevitably contained in steel. S deteriorates the corrosion resistance because of the formation a water-soluble sulfide such as CaS and MnS. In this embodiment, MnS is likely to be especially formed due to the high Mn content of more than 0.30% and the deterioration in the corrosion resistance is likely to occur. At a S content exceeding 0.005%, the corrosion resistance is deteriorated considerably owing to the formation of a large amount of MnS. Therefore, the S amount is confined to be 0.005% or less, preferably 0.003% or less, more preferably 0.002% or less.

Cr: More than 22.0% and 28.0% or Less

Cr is a chemical element which is the most important for ensuring the corrosion resistance of the ferritic stainless steel. Especially, in this embodiment, a Mn content is large to ensure a significantly excellent temper-color removal performance. Therefore, the effect to improve the corrosion resistance by Mn reduction cannot be expected. Accordingly, in this embodiment, Cr is an important chemical element to ensure the corrosion resistance at a certain level or more.

The present invention is premised on an excellent corrosion resistance. Therefore, it is preferable that the Cr content be as large as possible. With a Cr content of 22.0% or less, a sufficient corrosion resistance cannot be obtained in a welded portion where Cr in the surface layer is reduced by oxidation due to welding and in a Cr depletion region at the periphery of NbN precipitate containing Cr. On the other hand, at a Cr content exceeding 28.0%, the removal performance for the temper color is deteriorated rapidly. At a Cr content exceeding 28.0%, the workability and the manufacturability also are deteriorated. Therefore, the Cr content is confined to be in the range of more than 22.0% and 28.0% or less, preferably in the range from 22.3% to 26.0%, more preferably in the range from 22.4% to 25.0%.

Ni: 0.01% or More and Less than 0.30%

Ni improves the corrosion resistance of the stainless steel. In particular, Ni inhibits the progress of corrosion in the corrosion environment where a passivation film cannot be formed and active dissolution occurs. This effect can be obtained by setting a Ni content of 0.01% or more. However, at a Ni content of 0.30% or more, a cost increase since Ni is an expensive chemical element in addition to deterioration in workability. Thus, the Ni content is confined to be less than 0.30. Therefore, the Ni content is confined to be in the range of 0.01% or more and less than 0.30%, preferably in the range from 0.03% to 0.24%, more preferably in the range from 0.05% to 0.15%.

Mo: 0.2% to 3.0%

Mo promotes repassivation of a passivation film, so that the corrosion resistance of the ferritic stainless steel is improved. This effect can be more remarkable by containing Mo together with Cr in a content of more than 22.0%. The effect of improving the corrosion resistance by Mo can be obtained by setting a Mo content of 0.2% or more. However, at a Mo content exceeding 3.0%, the manufacturability is deteriorated owing to a large rolling load which is cased by an increase in the strength. Therefore, the Mo content is confined to be in the range from 0.2% to 3.0%, preferably in the range from 0.6% to 2.4%, more preferably in the range from 0.8% to 1.5%.

Al: 0.01% to 0.15%

Al is a chemical element effective for deoxidation. This effect can be obtained with an Al content of 0.01% or more. However, at an Al content exceeding 0.15%, the removal performance for the temper color is deteriorated because Al is concentration in the temper color. Therefore, the Al content is confined to be in the range from 0.01% to 0.15%, preferably in the range from 0.015% to 0.08%, more preferably in the range from 0.02% to 0.06%.

Ti: More than 0.30% and 0.80% or Less

Ti combines preferentially with C and N, so that the deterioration in corrosion resistance due to the precipitation of Cr carbonitride is inhibited. In this embodiment, Ti reduces the sensitization of the weld bead by combining with N which has invaded in the weld bead through a shielding gas. Furthermore, Ti has effects that improves the corrosion resistance by strengthening the passivation film and improves the removal performance for the temper color by combining with N as TiN. These effects become remarkable when the Ti content is more than 0.30%. However, at a Ti content exceeding 0.80%, the removal performance for the temper color is deteriorated owing to the concentration of Ti in the temper color. Therefore, the Ti content is confined to be in the range of more than 0.30% and 0.80% or less, preferably in the range from 0.32% to 0.60%, more preferably in the range from 0.37% to 0.50%.

Nb: Less than 0.050%

Nb combines preferentially with C and N, so that the deterioration in the corrosion resistance due to the precipitation of Cr carbonitride is inhibited. Since Nb is concentrated in the vicinity of the interface between the ferritic stainless steel and the temper color formed on the surface of the ferritic stainless steel, the removal performance for the temper color is deteriorated. Therefore, the Nb content is confined to be less than 0.050%.

However, a low content of Nb increases the removal performance for the temper color. To obtain this effect, it is preferable that the Nb content be confined to be 0.001% to less than 0.050%, more preferably in the range from 0.002% to 0.008%.

V: 0.001% to 0.080%

V improves the corrosion resistance. Therefore, V is a necessary chemical element for enhancing the corrosion resistance of the ferritic stainless steel to a certain level or more. This effect can be obtained with the V content of 0.001% or more. However, at a V content exceeding 0.080%, the removal performance for the temper color is deteriorated owing to the concentration of V along with Nb at the interface between the steel and the temper color. Therefore, the V content is confined to be in the range from 0.001% to 0.080%, preferably in the range from 0.002% to 0.060%, more preferably in the range from 0.005% to 0.050%.

N: 0.001% to 0.030%

N is a chemical element which improves the removal performance for the temper color by generating TiN precipitation on the surface. This effect can be obtained with the N content of 0.001% or more. However, a high N content to the extent that cannot be stabilized by Ti might cause precipitation of Cr nitride slightly reduces the corrosion resistance. Therefore, the N content is confined to be in the range from 0.001% to 0.030%, preferably in the range from 0.002% to 0.025%, more preferably in the range from 0.002% to 0.022%.

Density Distribution of TiN Having the Grain Diameter of 1 μm or More on the Steel Surface: 30 Particles/mm$^2$ or More The temper color formed on the steel surface in the manufacturing process of the ferritic stainless steel is removed typically by an acid treatment or an electrolytic treatment. The temper color of the ferritic stainless steel is formed of the oxides of Si, Al, Cr, and the like. These oxides are stable to acid and electric potential compared with the steel itself and less likely to be dissolved. Therefore, in the case where the temper color is removed by an acid treatment, an electrolytic treatment, or the like, the removal is performed by dissolution of the Cr depletion region just under the temper color and peeling off the temper color. At this time, when the temper color uniformly and densely protects the surface of the base iron, an acid or an electrolytic solution does not reach the Cr depletion region. This deteriorates the removal performance for the temper color.

In the case where a coarse TiN particle having a grain diameter of 1 μm or more exists on the steel surface, the supply of chemical elements to form oxides of Cr and the like is delayed just above TiN. This makes it difficult to form a fine oxide film which is excellent in protection performance. Therefore, the temper color is likely to be dissolved just above TiN. Since an acid or an electrolytic solution penetrates into the steel itself though this area, the removal performance for the temper color is improved. This improvement of the removal performance for the temper color can be obtained by distribution of TiN having a grain diameter of 1 μm or more on the steel surface at a density of 30 particles/mm$^2$ or more, preferably at a density from 35 particles/mm$^2$ or more to 150 particles/mm$^2$, and more preferably at a density from 35 particles/mm$^2$ to 100 particles/mm$^2$.

The basic chemical components of the ferritic stainless steel according to embodiments of the present invention are as described above and the balance being Fe and inevitable impurities. Further, a mass concentration ratio Mn/Si between Mn and Si contained in the steel may be specified.

Mn/Si≥2.0

As described above, the Mn oxide can be easily removed by an acid treatment or an electrolytic treatment compared with the Si oxide. Therefore, to improve the removal performance for the temper color, it is preferable that Mn contained in the temper color is as large as possible. As Mn contained in the steel is increased, a larger amount of Mn is concentrated in the temper color formed on the surface. However, in the case where a large amount of Si is contained at the same time even when a large amount of Mn is contained in the steel, Si is more preferentially concentrated in the temper color than Mn. Therefore, the removal performance for the temper color is deteriorated. At a mass concentration ratio Mn/Si of 2.0 or more between Mn and Si contained in the steel, the concentration of Mn in the temper color is enhanced and a significantly excellent removal performance for the temper color is obtained. A preferable Mn/Si is 3.0 or more.

Further, from the viewpoints of improving the corrosion resistance and improving the workability, the ferritic stainless steel according to this embodiment may contain one or more components selected from the group consisting of Cu, Zr, W, and B as a selected chemical element in the following ranges.

Cu: 1.0% or Less

Cu improves the corrosion resistance of the stainless steel. This effect can be obtained with a Cu content of 0.01% or more. However, at an excessive Cu content, the corrosion resistance is deteriorated because the passive current increases and the passivation becomes film unstable. Therefore, it is preferable that the Cu content be 1.0% or less in the case where Cu is contained. A more preferable Cu amount is 0.6% or less.

Zr: 1.0% or Less

Zr combines with C and N, so that the sensitization is reduced. This effect can be obtained with a Zr content of 0.01% or more. However, at an excessive Zr content, the workability is deteriorated and a cost increase since Zr is a considerably expensive chemical element. Therefore, it is preferable that the Zr content is 1.0% or less in the case where Zr is contained. A more preferable Zr content is 0.6% or less.

W: 1.0% or Less

W improves the corrosion resistance similarly to Mo. This effect can be obtained with a W content of 0.01% or more. However, at an excessive W content, the manufacturability is deteriorated by a large rolling load caused by an increase in the strength. Therefore, it is preferable that the W content is 1.0% or less in the case where W is contained. A more preferable W amount is 0.6% or less.

B: 0.1% or Less

B improves the secondary working brittleness resistance. To obtain this effect, it is appropriate that the B content is 0.0001% or more. However, at an excessive B content, the ductility is deteriorated owing to solid solution strengthening. Therefore, it is preferable that the B content is 0.1% or less in the case where B is contained. A more preferable B content is 0.01% or less.

2. Property of the Ferritic Stainless Steel According to the Third Embodiment

In common with the first embodiment and the second embodiment, the ferritic stainless steel according to the third embodiment has a corrosion resistance at a certain level or more and a removal performance for the temper color at a certain level or more.

The ferritic stainless steel according to the third embodiment has a significantly excellent removal performance for the temper color and an excellent workability since the Mn content is more than 0.30% to 2.00%, the Ni content is 0.01% to less than 0.30%, and the S content is 0.005% or less in the component composition according to the third embodiment.

3. Regarding a Manufacturing Method

Next, a method for manufacturing the ferritic stainless steel according to this embodiment will be described.

The stainless steel having the above-described chemical composition is heated from 1100° C. to 1300° C. and then hot-rolled at a finishing temperature from 700° C. to 1000° C. and a coiling temperature from 500° C. to 900° C. so as to have a sheet thickness from 2.0 mm to 5.0 mm. The hot-rolled steel sheet thus prepared is annealed at a temperature from 800° C. to 1000° C. and pickled. Causing a pickling weight loss of 0.5 g/m$^2$ or more in this pickling allows the appearance of TiN at 30 particles/mm$^2$ or more on the steel surface to improve the removal performance for the temper color that is generated on the surface of this hot-rolled, annealed and pickled steel sheet in the case where the hot-rolled, annealed and pickled steel sheet is welded.

Subsequently, the steel sheet is cold-rolled into a cold-rolled sheet, and subjected to annealing at a temperature from 800° C. to 1000° C. for a duration of 5 seconds or more and pickling. Also in this pickling, causing a pickling weight loss of 0.5 g/m$^2$ or more allows the appearance of TiN at 30 particles/mm$^2$ or more on the surface to improve the removal performance for the temper color formed on the surface by the subsequent annealing and welding. Pickling methods include acid dipping such as pickling by sulfuric acid, pickling by nitric acid, and pickling by nitric hydrofluoric acid and/or electrolytic pickling such as electrolytic pickling by neutral salt and electrolytic pickling by mixed solution of nitric acid and hydrochloric acid. These pickling methods may be combined together.

EXAMPLES

The present invention will be described in reference to examples hereafter.

Example 1

Stainless steels given in Table 1 were prepared using a vacuum melting furnace, heated to 1200° C., and then hot-rolled into hot-rolled steel sheets having a sheet thickness of 4 mm, and the steel sheets were subjected to annealing in the range from 850° C. to 950° C. and descaling by pickling. Furthermore, the steel sheets were cold-rolled into cold-rolled steel sheets having a sheet thickness of 0.8 mm, and subjected to annealing in the range from 850° C. to 900° C. for a duration of 1 min or more. The cooling rate after the annealing was set to 5 to 50° C./s from the annealing temperature to 500° C. Subsequently, the steel sheets were subjected to electrolytic pickling where the electric quantity/area was 20 to 150 C/dm$^2$ in a mixed acid solution containing nitric acid in a concentration of 15 mass % and hydrochloric acid in a concentration of 10 mass % for sample materials. The cooling rate, the electric quantity/area of electrolytic pickling, the pickling weight loss, and the sheet thickness reduction are given in Table 2.

TABLE 1

| | mass % | | | | | | | | | | | | | | |
|---|---|---|---|---|---|---|---|---|---|---|---|---|---|---|---|
| Steel Type No | C | Si | Mn | P | S | Cr | Ni | Mo | Al | Ti | V | N | Nb | Other Chemical Elements | Remarks |
| 1 | 0.006 | 0.12 | 0.10 | 0.022 | 0.003 | 22.8 | 0.09 | 0.82 | 0.03 | 0.36 | 0.02 | 0.009 | — | | Inventive Steel |
| 2 | 0.010 | 0.11 | 0.12 | 0.020 | 0.002 | 23.0 | 0.10 | 0.85 | 0.04 | 0.32 | 0.04 | 0.009 | — | | Inventive Steel |
| 3 | 0.011 | 0.12 | 0.12 | 0.020 | 0.003 | 25.1 | 0.10 | 0.84 | 0.04 | 0.37 | 0.04 | 0.014 | — | | Inventive Steel |
| 4 | 0.007 | 0.06 | 0.10 | 0.020 | 0.003 | 23.8 | 0.08 | 0.85 | 0.05 | 0.35 | 0.04 | 0.016 | — | | Inventive Steel |
| 5 | 0.007 | 0.17 | 0.10 | 0.018 | 0.001 | 23.2 | 0.08 | 0.82 | 0.06 | 0.35 | 0.02 | 0.018 | — | | Inventive Steel |
| 6 | 0.010 | 0.09 | 0.11 | 0.019 | 0.001 | 23.2 | 0.14 | 0.91 | 0.08 | 0.36 | 0.03 | 0.018 | — | | Inventive Steel |
| 7 | 0.010 | 0.08 | 0.12 | 0.019 | 0.003 | 23.3 | 0.22 | 0.93 | 0.03 | 0.33 | 0.03 | 0.014 | — | | Inventive Steel |

TABLE 1-continued

| Steel Type No | C | Si | Mn | P | S | Cr | Ni | Mo | Al | Ti | V | N | Nb | Other Chemical Elements | Remarks |
|---|---|---|---|---|---|---|---|---|---|---|---|---|---|---|---|
| | mass % | | | | | | | | | | | | | | |
| 8 | 0.011 | 0.08 | 0.12 | 0.019 | 0.001 | 23.1 | 0.09 | 2.10 | 0.07 | 0.39 | 0.05 | 0.014 | — | | Inventive Steel |
| 9 | 0.011 | 0.08 | 0.12 | 0.020 | 0.002 | 23.0 | 0.08 | 0.92 | 0.01 | 0.54 | 0.06 | 0.014 | 0.007 | | Inventive Steel |
| 10 | 0.011 | 0.10 | 0.10 | 0.020 | 0.001 | 22.9 | 0.08 | 1.04 | 0.02 | 0.36 | 0.03 | 0.013 | — | Cu: 0.41 | Inventive Steel |
| 11 | 0.010 | 0.09 | 0.12 | 0.021 | 0.002 | 24.0 | 0.10 | 1.10 | 0.03 | 0.36 | 0.02 | 0.013 | — | Zr: 0.12 | Inventive Steel |
| 12 | 0.009 | 0.10 | 0.11 | 0.020 | 0.002 | 24.1 | 0.10 | 1.05 | 0.03 | 0.35 | 0.07 | 0.012 | 0.007 | W: 0.16 | Inventive Steel |
| 13 | 0.009 | 0.09 | 0.11 | 0.020 | 0.002 | 23.7 | 0.09 | 1.27 | 0.03 | 0.35 | 0.02 | 0.014 | 0.006 | B0.002 | Inventive Steel |
| 14 | 0.009 | 0.38 | 0.11 | 0.020 | 0.002 | 23.8 | 0.10 | 1.01 | 0.01 | 0.32 | 0.04 | 0.012 | — | | Comparative Steel |
| 15 | 0.010 | 0.11 | 0.11 | 0.020 | 0.001 | 24.0 | 0.09 | 1.02 | 0.32 | 0.31 | 0.04 | 0.015 | — | | Comparative Steel |
| 16 | 0.010 | 0.11 | 0.12 | 0.018 | 0.003 | 22.9 | 0.10 | 0.99 | 0.02 | 0.14 | 0.03 | 0.015 | — | | Comparative Steel |
| 17 | 0.010 | 0.10 | 0.12 | 0.018 | 0.002 | 19.7 | 0.08 | 0.98 | 0.02 | 0.31 | 0.03 | 0.016 | 0.005 | | Comparative Steel |
| 18 | 0.008 | 0.09 | 0.12 | 0.020 | 0.002 | 23.0 | 0.09 | 1.00 | 0.02 | 0.32 | 0.03 | 0.013 | 0.121 | | Comparative Steel |
| 19 | 0.008 | 0.08 | 0.12 | 0.020 | 0.003 | 23.1 | 0.10 | 1.05 | 0.03 | 0.33 | 0.20 | 0.013 | 0.005 | | Comparative Steel |

Note:
Under line indicates a value out of the range of the present invention

The surfaces of the prepared sample materials were observed through scanning electron microscope (SEM) and the distribution density of TiN existing on the surface was obtained with the method described below. Firstly, 10 fields of view in a range of 100 μm×100 μm on the surface of the sample material were arbitrarily observed through SEM to observe the precipitates on the surface. Among the observed precipitates, a precipitate in a shape that has a grain diameter of 1 μm or more and is close to a cubical crystal was assumed to be TiN. In the measurement method of the grain diameter, the respective major axis and minor axis of the TiN observed through SEM were measured and the average of the measurements was set to a grain diameter. The number of TiN particles in 10 fields of view was counted and averaged to calculate the number of TiN particles per 1 $mm^2$. The calculated numbers of TiN particles were given in Table 2.

To analyze TiN more in detail, the precipitate was extracted by electroextraction and observed through transmission electron microscope (TEM). As the result of the elemental analysis on the precipitate by Energy Dispersive x-ray Spectroscopy (EDS) built into TEM, precipitation of NbN with a thickness from 5 to 50 nm attached to a coarse TiN having 1 μm or more was confirmed only in the case where a Nb-containing steel was used. While Cr was hardly seen in the TiN which was the site of the precipitate, the existence of Cr was confirmed in the NbN attached to the TiN. When the ratio Cr/Nb of Cr and Nb contained in NbN was analyzed by EDS of TEM, the Cr/Nb was within the range from 0.05 to 0.50 in any NbN. Here, the existence or nonexistence of Nb precipitation in the respective sample materials was given in Table 2.

Bead on plate using TIG welding was performed on the prepared sample materials. The welding current was set to 90 A and the welding speed was set to 60 cm/min. As the shielding gas, 100% Ar was used only on the front side (welding electrode side) while the shielding gas was not used on the back side. The flow rate of the shielding gas was set to 15 L/min. The width of the weld bead on the front side was about 4 mm.

An absorbent cotton wet with a phosphoric acid solution in a concentration of 10 mass % was brought into contact with the temper colors on the front and back of the prepared weld bead. Then, an electrolytic treatment was performed while the electric quantity/area was varied in the range from 1 C/$dm^2$ to 15 C/$dm^2$. After the electrolytic treatment, the element distribution of the welded portion in the depth direction was measured with Glow Discharge Spectroscopy (GDS). The condition where a larger amount of the chemical elements such as Si and Al concentrated in the temper color was seen in the surface layer compared with that in base iron was determined as the existence of the residual temper color. The case where there was no residual temper color after the electrolytic treatment at an electric quantity/area of 6 C/$dm^2$ or less was indicated by ◎ (satisfactory, significantly excellent). The case where there was no residual temper color after the electrolytic treatment at an electric quantity/area of 10 C/$dm^2$ or less was indicated by ○ (satisfactory, excellent). The case where there was a residual temper color after the electrolytic treatment at an electric quantity/area of more than 10 C/$dm^2$ was indicated by x (unsatisfactory). The result was given in the column of the existence or nonexistence of the residual temper color of the weld bead in Table 2.

The residual temper colors were confirmed even at an electric quantity/area of more than 10 C/$dm^2$ in No. 1 where the pickling weight loss was insufficient and the number of TiN on the steel sheet surface was smaller than 30 particles/$mm^2$, in No. 20 where the Ti content was below the preferred range of the present invention and the number of TiN on the steel sheet surface was smaller than 30 particles/$mm^2$, and in No. 18, No. 19, No. 20, No. 22, and No. 23 where the amount of any of Si, Ti, Al, Nb, and V was over the preferred composition range of the present invention. In No. 13, No. 16, and No. 17 where all the components were within the preferred composition range of the present invention and the precipitation of NbN was confirmed and in No. 21 where the content of Cr was below the preferred composition range of the present invention but the precipitation of NbN was confirmed, there was no residual temper color at an electric quantity/area of 6 C/$dm^2$ or less and the removal performance for the temper color was significantly excellent. The other inventive examples correspond to "○ (the case where there was no residual temper color at an electric quantity/area of 10 C/$dm^2$ or less)," and thus, it was confirmed that this embodiment had an excellent removal performance for the temper color.

The weld bead of the sample material was processed by the electrolytic treatment in the phosphoric acid solution in a concentration of 10 mass %, and subsequently, the specimens including a weld bead length of 50 mm were cut and dipped in NaCl in a concentration of 5 mass % at 80° C. for one week. After the dipping, the existence or nonexistence of corrosion was investigated. The immersion test was carried out on the sample material with no corrosion for one more week, and then the existence or nonexistence of corrosion was investigated. The result is given in the column of the existence or nonexistence of corrosion in the immersion test after the removal of the temper color in Table 2. The case where there was corrosion after dipping for one week was indicated by x (unsatisfactory). The case where there was no corrosion after dipping for one week but there was corrosion after dipping for two weeks was indicated by ○ (satisfactory, excellent). The case where there was no corrosion after two weeks was indicated by ◎ (satisfactory, significantly excellent).

In any of No. 1, No. 18, No. 19, No. 20, No. 22, and No. 23 with residual temper colors, it was confirmed that corrosion occurred and the corrosion resistance was poor. Also in No. 21 where the Or content departed from the preferred range of the present invention, it was confirmed that corrosion occurred and the corrosion resistance was poor. In any of No. 2 through No. 17 as the examples of present invention, there was no residual temper color and the corrosion resistance was significantly excellent. This result confirmed that this embodiment had an excellent removal performance for the temper color.

The above-described sample materials with the sheet thickness of 0.8 mm manufactured with the above-described method were processed into a tensile test specimens in accordance with JIS No. 13B for 0° (L direction), 45° (D direction), and 90° (C direction) with respect to the rolling direction. A tensile test was carried out twice for each direction to measure the weighted average ((L+2D+C)/4) of the elongation in the three directions. The tension rate was set to 10 mm/min, and the gauge length was set to 50 mm. The case where the obtained weighted average of the elongation in the three directions was 28% or more was indicated by ◎ (satisfactory, excellent). The case where the weighted average was 25% or more and less than 28% was indicated by ○ (satisfactory) as an excellent workability. The case where the weighted average was less than 25% was indicated by x (unsatisfactory). The result was given in the column of the elongation (average of the three directions) in Table 2. It was confirmed that any of the inventive examples had an excellent workability.

TABLE 2

| | | Pickling Conditions | | | Distribution | Existence or |
|---|---|---|---|---|---|---|
| No. | Steel Type No | Electrolysis Electric Quantity/Area C/dm$^2$ | Pickling Weight Loss g/m$^2$ | Reduction in Thickness μm | Density of TiN having 1 μm or more particles/mm$^2$ | Nonexistence of Precipitation of NbN on TiN Surface having 1 μm or more |
| 1 | 1 | 20 | 0.41 | 0.04 | 21 | Nonexistence |
| 2 | 1 | 50 | 0.72 | 0.08 | 35 | Nonexistence |
| 3 | 1 | 90 | 1.28 | 0.15 | 61 | Nonexistence |
| 4 | 1 | 110 | 1.58 | 0.22 | 74 | Nonexistence |
| 5 | 1 | 150 | 2.09 | 0.28 | 92 | Nonexistence |
| 6 | 2 | 70 | 0.97 | 0.11 | 63 | Nonexistence |
| 7 | 3 | 70 | 0.89 | 0.12 | 121 | Nonexistence |
| 8 | 4 | 70 | 0.91 | 0.12 | 71 | Nonexistence |
| 9 | 5 | 70 | 0.92 | 0.12 | 67 | Nonexistence |
| 10 | 6 | 70 | 0.98 | 0.13 | 48 | Nonexistence |
| 11 | 7 | 70 | 1.01 | 0.13 | 49 | Nonexistence |
| 12 | 8 | 70 | 0.97 | 0.12 | 54 | Nonexistence |
| 13 | 9 | 70 | 0.96 | 0.12 | 50 | Existence |
| 14 | 10 | 70 | 0.92 | 0.12 | 41 | Nonexistence |
| 15 | 11 | 70 | 0.98 | 0.13 | 60 | Nonexistence |
| 16 | 12 | 70 | 0.98 | 0.13 | 58 | Existence |
| 17 | 13 | 70 | 0.99 | 0.13 | 58 | Existence |
| 18 | 14 | 70 | 0.79 | 0.10 | 42 | Nonexistence |
| 19 | 15 | 70 | 0.86 | 0.11 | 45 | Nonexistence |
| 20 | 16 | 70 | 1.01 | 0.13 | 13 | Nonexistence |
| 21 | 17 | 70 | 1.06 | 0.13 | 53 | Existence |
| 22 | 18 | 70 | 0.95 | 0.12 | 68 | Existence |
| 23 | 19 | 70 | 0.97 | 0.12 | 54 | Existence |

| No. | Existence or Nonexistence of Residual Temper Color of Weld Bead | Existence or Nonexistence of Corrosion in Immersion Test after Removal of Temper Color | Elongation (Average of Three Directions) | Remarks |
|---|---|---|---|---|
| 1 | X | X | ◎ | Comparative Example |
| 2 | ○ | ◎ | ◎ | Inventive Example |
| 3 | ○ | ◎ | ◎ | Inventive Example |
| 4 | ○ | ◎ | ◎ | Inventive Example |
| 5 | ○ | ◎ | ◎ | Inventive Example |
| 6 | ○ | ◎ | ◎ | Inventive Example |
| 7 | ○ | ◎ | ◎ | Inventive Example |
| 8 | ○ | ◎ | ◎ | Inventive Example |
| 9 | ○ | ◎ | ◎ | Inventive Example |
| 10 | ○ | ◎ | ◎ | Inventive Example |
| 11 | ○ | ◎ | ◎ | Inventive Example |
| 12 | ○ | ◎ | ◎ | Inventive Example |
| 13 | ◎ | ◎ | ◎ | Inventive Example |
| 14 | ○ | ◎ | ◎ | Inventive Example |
| 15 | ○ | ◎ | ◎ | Inventive Example |
| 16 | ◎ | ◎ | ◎ | Inventive Example |

TABLE 2-continued

| | | | | |
|---|---|---|---|---|
| 17 | ◎ | ◎ | ◎ | Inventive Example |
| 18 | X | X | ○ | Comparative Example |
| 19 | X | X | ○ | Comparative Example |
| 20 | X | X | ◎ | Comparative Example |
| 21 | ◎ | X | ◎ | Comparative Example |
| 22 | X | X | ○ | Comparative Example |
| 23 | X | X | ◎ | Comparative Example |

Note:
Under line indicates a value out of the range of the present invention

Example 2

Stainless steels given in Table 3 were prepared using a vacuum melting furnace, heated to 1200° C., and then hot-rolled into hot-rolled steel sheets having a sheet thickness of 4 mm, and the steel sheets were subjected to annealing in the range from 850° C. to 950° C. and pickling to remove scales formed in the hot rolling. Furthermore, the steel sheets were cold-rolled into cold-rolled steel sheets having a sheet thickness of 0.8 mm and subjected to annealing in the range from 850° C. to 900° C. for a duration of 1 min or more. Subsequently, the steel sheets were subjected to electrolytic pickling in a mixed acid solution containing nitric acid in a concentration of 15 mass % and hydrochloric acid in a concentration of 10 mass % for complete remove of the temper color generated during the annealing, for sample materials. The electric quantity/area during the electrolytic pickling was set to 80 C/dm$^2$ except X8 and set to 40 C/dm$^2$ for X8. The respective pickling weight losses were 0.6 g/m$^2$ to 1.1 g/m$^2$ except X8, for which the loss was 0.4 g/m$^2$.

The surfaces of the prepared sample materials were observed through SEM and the distribution density of TiN existing on the surface was obtained with the method described below. Firstly, 10 fields of view in a range of 100 μm×100 μm on the surface of the sample material were arbitrarily observed through SEM to observe the precipitates on the surface. Among the observed precipitates, a precipitate in a shape that has a grain diameter of 1 μm or more and is close to a cubical crystal is assumed to be TiN. In the measurement method of the grain diameter of the precipitate, the respective major axis and minor axis of the TiN observed through SEM were measured and the average of the measurements was set to a grain diameter. The number of TiN having grain diameters of 1 μm or more in 10 fields of view was counted and averaged to calculate the number of TiN per 1 mm$^2$. The calculated numbers of TiN are given in Table 4.

The prepared sample materials were cut into a size of 50 mm×40 mm. Then, two sheets were lapped and one side of 50 mm was bonded by fillet welding of lap joint from the end surface to prepare the specimens with weld crevice struc-

TABLE 3

| | mass % | | | | | | | | | | | | | | |
|---|---|---|---|---|---|---|---|---|---|---|---|---|---|---|---|
| Steel Type | C | Si | Mn | P | S | Cr | Ni | Mo | Al | Ti | Nb | V | N | Other Chemical Elements | Remarks |
| A | 0.004 | 0.09 | 0.10 | 0.02 | 0.001 | 22.9 | 0.35 | 1.01 | 0.05 | 0.33 | 0.001 | 0.02 | 0.007 | | Inventive Steel |
| B | 0.005 | 0.08 | 0.15 | 0.03 | 0.003 | 23.0 | 1.29 | 0.82 | 0.04 | 0.35 | 0.002 | 0.02 | 0.005 | | Inventive Steel |
| C | 0.004 | 0.08 | 0.13 | 0.02 | 0.003 | 23.0 | 2.22 | 0.85 | 0.04 | 0.33 | 0.002 | 0.03 | 0.008 | | Inventive Steel |
| D | 0.005 | 0.10 | 0.12 | 0.02 | 0.003 | 22.8 | 3.01 | 0.52 | 0.05 | 0.37 | 0.001 | 0.03 | 0.008 | | Inventive Steel |
| E | 0.005 | 0.10 | 0.15 | 0.02 | 0.002 | 24.2 | 3.99 | 0.56 | 0.07 | 0.36 | 0.001 | 0.02 | 0.009 | | Inventive Steel |
| F | 0.005 | 0.10 | 0.14 | 0.02 | 0.002 | 22.5 | 4.85 | 0.58 | 0.07 | 0.36 | 0.005 | 0.02 | 0.007 | | Inventive Steel |
| G | 0.010 | 0.22 | 0.13 | 0.01 | 0.003 | 22.6 | 0.41 | 1.14 | 0.09 | 0.37 | 0.006 | 0.04 | 0.007 | | Inventive Steel |
| H | 0.012 | 0.18 | 0.15 | 0.01 | 0.001 | 25.2 | 0.42 | 1.23 | 0.08 | 0.39 | 0.012 | 0.04 | 0.009 | | Inventive Steel |
| I | 0.009 | 0.15 | 0.15 | 0.01 | 0.001 | 23.0 | 0.37 | 2.04 | 0.08 | 0.38 | 0.015 | 0.05 | 0.009 | | Inventive Steel |
| J | 0.006 | 0.16 | 0.22 | 0.02 | 0.001 | 23.1 | 0.38 | 1.08 | 0.12 | 0.41 | 0.014 | 0.01 | 0.010 | | Inventive Steel |
| K | 0.006 | 0.13 | 0.21 | 0.03 | 0.002 | 22.7 | 2.41 | 1.08 | 0.10 | 0.43 | 0.011 | 0.05 | 0.011 | | Inventive Steel |
| L | 0.005 | 0.15 | 0.18 | 0.03 | 0.003 | 22.7 | 2.78 | 1.02 | 0.03 | 0.56 | 0.013 | 0.06 | 0.010 | | Inventive Steel |
| M | 0.006 | 0.14 | 0.19 | 0.02 | 0.002 | 22.5 | 2.77 | 0.95 | 0.04 | 0.40 | 0.033 | 0.05 | 0.011 | | Inventive Steel |
| N | 0.005 | 0.11 | 0.15 | 0.02 | 0.003 | 24.0 | 2.65 | 0.94 | 0.04 | 0.38 | 0.020 | 0.07 | 0.008 | | Inventive Steel |
| O | 0.004 | 0.10 | 0.16 | 0.02 | 0.002 | 23.4 | 1.87 | 0.95 | 0.07 | 0.37 | 0.019 | 0.04 | 0.009 | Cu: 0.5, Zr: 0.1 | Inventive Steel |
| P | 0.007 | 0.13 | 0.16 | 0.02 | 0.001 | 23.2 | 2.55 | 1.06 | 0.08 | 0.42 | 0.009 | 0.06 | 0.008 | Cu: 0.3 | Inventive Steel |
| Q | 0.006 | 0.12 | 0.18 | 0.02 | 0.001 | 24.6 | 3.42 | 0.91 | 0.09 | 0.46 | 0.010 | 0.08 | 0.009 | Zr: 0.2 | Inventive Steel |
| R | 0.004 | 0.11 | 0.15 | 0.02 | 0.002 | 23.4 | 2.03 | 1.06 | 0.07 | 0.38 | 0.019 | 0.02 | 0.015 | W: 0.1 | Inventive Steel |
| S | 0.005 | 0.11 | 0.12 | 0.01 | 0.003 | 23.3 | 2.12 | 1.10 | 0.06 | 0.38 | 0.018 | 0.02 | 0.014 | B: 0.004 | Inventive Steel |
| x1 | 0.008 | 0.43 | 0.14 | 0.02 | 0.003 | 22.9 | 1.55 | 0.84 | 0.05 | 0.40 | 0.005 | 0.03 | 0.009 | | Comparative Steel |
| x2 | 0.007 | 0.15 | 0.12 | 0.02 | 0.003 | 19.6 | 1.01 | 0.85 | 0.05 | 0.40 | 0.005 | 0.04 | 0.010 | | Comparative Steel |
| x3 | 0.005 | 0.09 | 0.13 | 0.02 | 0.002 | 22.8 | 0.11 | 1.02 | 0.06 | 0.41 | 0.010 | 0.04 | 0.012 | | Inventive Steel |
| x4 | 0.005 | 0.09 | 0.10 | 0.01 | 0.002 | 22.9 | 0.78 | 0.02 | 0.06 | 0.38 | 0.011 | 0.02 | 0.012 | | Comparative Steel |
| x5 | 0.005 | 0.10 | 0.10 | 0.01 | 0.002 | 23.4 | 0.57 | 1.03 | 0.31 | 0.38 | 0.011 | 0.01 | 0.011 | | Comparative Steel |
| x6 | 0.006 | 0.10 | 0.13 | 0.02 | 0.003 | 24.1 | 0.58 | 1.01 | 0.07 | 0.16 | 0.21 | 0.03 | 0.008 | | Comparative Steel |
| x7 | 0.007 | 0.10 | 0.15 | 0.02 | 0.003 | 23.0 | 0.64 | 0.99 | 0.07 | 0.39 | 0.008 | 0.18 | 0.008 | | Comparative Steel |
| x8 | 0.006 | 0.19 | 0.15 | 0.01 | 0.001 | 22.5 | 0.64 | 0.99 | 0.07 | 0.31 | 0.011 | 0.05 | 0.008 | | Inventive Steel |

Note:
Under line indicates a value out of the range of the present invention tures. Hereinafter, this welded specimen of two lapped sheets prepared by fillet welding of lap joint is referred to as a lapped test piece. The shape of the lapped test piece is illustrated in FIG. 1. Welding was performed by TIG welding under the condition where the welding speed was 60 cm/min and the welding current was 90 A. The shielding used gas was 100% Ar and the gas flow rate was set to 20 L/min.

As the result of observation by dissection of the lapped test piece, the temper color was formed in a weld heat-affected zone on both the outer surface and the inner surface of the lapped portion. To evaluate the removal performance for this temper color, the lapped test piece was dipped in a mixed acid solution, which was heated to 50° C., containing hydrofluoric acid in a concentration of 5% and nitric acid in a concentration of 7% for 20 sec and then the specimen was dissected so as to evaluate the existence or nonexistence of the temper color in the weld heat-affected zone on the outer surface and the inner surface of the lapped portion by visual observation. The case where the residual temper color was obviously seen was evaluated as existence. The case where the temper color was not obviously seen was evaluated as nonexistence. The evaluation result is given in the column of the residual temper color after the immersion treatment of the lapped test piece in the mixed acid solution in Table 4.

In No. 2-1 through 2-19, and 2-22 as the examples of present invention and No. 2-21 and 2-23 as comparative examples, the residual temper color was not seen. In No. 2-20 and No. 2-24 through 2-27 as comparative examples, the residual temper color was seen.

The lapped test piece was dipped in a mixed acid solution, which is heated to 50° C., containing hydrofluoric acid in a concentration of 5% and nitric acid in a concentration of 7% for 20 sec. Subsequently, a corrosion test was carried out. In the corrosion test, the lapped test piece was dipped in a solution of NaCl in a concentration of 5% at 80° C. for one month. After the corrosion test, the specimen was dissected and the rust was removed using nitric acid in a concentration of 10%. Then, 10 positions where the penetration depth was considered to be deep were selected from corrosion generated on the inner surface of the lapped portion with the naked eye, the penetration depths were measured with a laser microscope, and the penetration depths in 10 points were averaged. The measured penetration depths are given in the column of the ten-point average penetration depth by the corrosion test of the lapped test piece in Table 4.

In any of No. 2-1 through No. 2-19 as the examples of present invention, the penetration depth was 200 μm or less, the penetration depth was shallow compared with the comparative examples, and an excellent corrosion resistance was provided in the weld crevice structure where the surface was oxidized by welding. On the other hand, in the comparative example No. 2-20 and the comparative examples No. 2-24 through 2-27 where there were the residual temper colors and in the comparative examples No. 2-21 and 2-23 where either of Cr and No was equal to or less than the preferred lower limit of the present invention, the penetration depth of the inner surface of the lapped portion was more than 200 μm, which was deep. It means that the corrosion resistance was insufficient. Here, the comparative example No. 2-27 employed the inventive steel X8 but had small pickling weight losses. Therefore, there were a small number of coarse TiN having a grain diameter of 1 μm or more on the surface and the temper color generated during welding was not sufficiently removed, therefore, the corrosion resistance is inferior. This result confirmed that this embodiment had an excellent crevice corrosion resistance.

Bead on plate using TIG welding was performed on the prepared sample materials. The welding current was set to 90 A and the welding speed was set to 60 cm/min. As the shielding gas, 100% Ar was used only on the front side (welding electrode side) while the shielding gas was not used on the back side. The flow rate of the shielding gas was set to 15 L/min. The width of the weld bead on the front side was about 4 mm.

An absorbent cotton wet with a phosphoric acid solution in a concentration of 10 mass % was brought into contact with the temper colors on the front and back of the prepared weld bead. Then, an electrolytic treatment was performed while the electric quantity/area was varied in the range from 1 C/dm$^2$ to 15 C/dm$^2$. After the electrolytic treatment, the element distribution in the welded portion in the depth direction was measured with GDS. The case where a larger amount of the chemical elements such as Si and Al concentrated in the temper color was seen in the surface layer compared with that in base iron was determined as the existence of the residual temper color. The case where there was no residual temper color in the electrolytic treatment at an electric quantity/area of 6 C/dm$^2$ or less was indicated by ◎ (satisfactory, significantly excellent). The case where there was no residual temper color in the electrolytic treatment at an electric quantity/area of 10 C/dm$^2$ or less was indicated by ○ (satisfactory, excellent). The case where there was a residual temper color in the electrolytic treatment at an electric quantity/area of more than 10 C/dm$^2$ was indicated by x (unsatisfactory). The result was indicated in the column of the existence or nonexistence of the residual temper color of the weld bead in Table 4.

As given in Table 4, No. 2-1 through 2-7, 2-8 through 2-19, and 2-22 as the examples of present invention and No. 2-21 and 2-23 as the comparative examples had significantly excellent results in the evaluation of the residual temper color of the weld bead. In contrast, in No. 2-20 and No. 2-24 through 2-27 as the comparative examples, the residual temper color was seen. This result confirmed that this embodiment had a significantly excellent removal performance for the temper color.

The weld bead of the sample material was processed by the electrolytic treatment in the phosphoric acid solution in a concentration of 10 mass %. Subsequently, the specimens including a weld bead length of 50 mm were cut and dipped in NaCl in a concentration of 5 mass % at 80° C. for one week. After the dipping, the existence or nonexistence of corrosion was investigated. The immersion test was carried out on the sample material with no corrosion for one more week, and then the existence or nonexistence of corrosion was investigated. The result is given in the column of the existence or nonexistence of corrosion in the immersion test after the removal of the temper color in Table 4. The case where there was corrosion after dipping for one week was indicated by x (unsatisfactory). The case where there was no corrosion after dipping for one week but there was corrosion after dipping for two weeks was indicated by ○ (satisfactory, excellent). The case where there was no corrosion after two weeks was indicated by ◎ (satisfactory, significantly excellent).

As given in Table 4, in No. 2-1 through 2-19 and 2-22 as the examples of present invention, the corrosion was not seen after the test for two weeks. On the other hand, in No. 2-20, 2-21, and 2-23 through 2-27 as the comparative examples, the corrosion was seen after the test for one week. This result confirmed that this embodiment had a significantly excellent corrosion resistance.

The above-described sample materials with the sheet thickness of 0.8 mm manufactured with the above-described method were processed into a tensile test specimens in accordance with JIS No. 13B for 0° (L direction), 45° (D direction), and 90° (C direction) with respect to the rolling direction. A tensile test was carried out twice for each direction so as to measure the weighted average ((L+2D+C)/4) of the elongation in the three directions. The tension rate was set to 10 ram/min, and the gauge length was set to 50 mm. The case where the obtained weighted average of the elongation in the three directions was 28% or more was indicated by ◎ (satisfactory, excellent). The case where the weighted average was 25% or more and less than 28% was indicated by ○ (satisfactory) as a good workability. The case where the weighted average was less than 25% was indicated by x (unsatisfactory). The result was given in the column of the elongation (average of the three directions) in Table 4. No. 2-22 showed an elongation of 28% or more. The other inventive examples showed elongations of 25% or more. The result is given in Table 4.

TABLE 4

| No | Steel Type | Distribution Density of TiN having 1 μm or more (particles/mm$^2$) | Residual Temper Color after Immersion Treatment of Lapped Test Piece in Mixed Acid Solution | Ten-point Average Penetration Depth by Corrosion Test of Lapped Test Piece (μm) |
|---|---|---|---|---|
| 2-1 | A | 41 | Nonexistence | 152 |
| 2-2 | B | 42 | Nonexistence | 155 |
| 2-3 | C | 40 | Nonexistence | 87 |
| 2-4 | D | 44 | Nonexistence | 74 |
| 2-5 | E | 49 | Nonexistence | 51 |
| 2-6 | F | 38 | Nonexistence | 32 |
| 2-7 | G | 39 | Nonexistence | 149 |
| 2-8 | H | 53 | Nonexistence | 141 |
| 2-9 | I | 51 | Nonexistence | 109 |
| 2-10 | J | 62 | Nonexistence | 136 |
| 2-11 | K | 71 | Nonexistence | 98 |
| 2-12 | L | 84 | Nonexistence | 95 |
| 2-13 | M | 66 | Nonexistence | 99 |
| 2-14 | N | 46 | Nonexistence | 86 |
| 2-15 | O | 50 | Nonexistence | 102 |
| 2-16 | P | 51 | Nonexistence | 80 |
| 2-17 | Q | 60 | Nonexistence | 64 |
| 2-18 | R | 86 | Nonexistence | 92 |
| 2-19 | S | 80 | Nonexistence | 89 |
| 2-20 | x1 | 54 | Existence | 310 |
| 2-21 | x2 | 60 | Nonexistence | 352 |
| 2-22 | x3 | 74 | Nonexistence | 411 |
| 2-23 | x4 | 68 | Nonexistence | 297 |
| 2-24 | x5 | 63 | Existence | 456 |
| 2-25 | x6 | 19 | Existence | 384 |
| 2-26 | x7 | 47 | Existence | 421 |
| 2-27 | x8 | 11 | Existence | 307 |

| No | Existence or Nonexistence of Residual Temper Color of Weld Bead | Existence or Nonexistence of Corrosion in Immersion Test after Removal of Temper Color | Elongation (Average of Three Directions) | Remarks |
|---|---|---|---|---|
| 2-1 | ◎ | ◎ | ○ | Inventive Example |
| 2-2 | ◎ | ◎ | ○ | Inventive Example |
| 2-3 | ◎ | ◎ | ○ | Inventive Example |
| 2-4 | ◎ | ◎ | ○ | Inventive Example |
| 2-5 | ◎ | ◎ | ○ | Inventive Example |
| 2-6 | ◎ | ◎ | ○ | Inventive Example |
| 2-7 | ◎ | ◎ | ○ | Inventive Example |
| 2-8 | ◎ | ◎ | ○ | Inventive Example |
| 2-9 | ◎ | ◎ | ○ | Inventive Example |
| 2-10 | ◎ | ◎ | ○ | Inventive Example |
| 2-11 | ◎ | ◎ | ○ | Inventive Example |
| 2-12 | ◎ | ◎ | ○ | Inventive Example |
| 2-13 | ◎ | ◎ | ○ | Inventive Example |
| 2-14 | ◎ | ◎ | ○ | Inventive Example |
| 2-15 | ◎ | ◎ | ○ | Inventive Example |
| 2-16 | ◎ | ◎ | ○ | Inventive Example |
| 2-17 | ◎ | ◎ | ○ | Inventive Example |
| 2-18 | ◎ | ◎ | ○ | Inventive Example |
| 2-19 | ◎ | ◎ | ○ | Inventive Example |
| 2-20 | X | X | ○ | Comparative Example |
| 2-21 | ◎ | X | ○ | Comparative Example |
| 2-22 | ◎ | ◎ | ◎ | Inventive Example |
| 2-23 | ◎ | X | ○ | Comparative Example |
| 2-24 | X | X | ○ | Comparative Example |
| 2-25 | X | X | ○ | Comparative Example |

TABLE 4-continued

| | | | | |
|---|---|---|---|---|
| 2-26 | X | X | ○ | Comparative Example |
| 2-27 | X | X | ○ | Comparative Example |

Note:
Under line indicates a value out of the range of the present invention

Example 3

Stainless steels given in Table 5 were prepared using a vacuum melting furnace, heated to 1200° C., and then hot-rolled into hot-rolled steel sheets having a sheet thickness of 4 mm, and the steel sheets were subjected to annealing in the range from 850° C. to 950° C. and pickling to remove scales formed in the hot rolling. Except No. 3-23 given in Table 6, the pickling weight loss was set to 0.8 g/m$^2$ to 1.1 g/m$^2$. In No. 3-23, the pickling weight loss was set to 0.21 g/m$^2$. Furthermore, the steel sheets were cold-rolled into cold-rolled steel sheets having a sheet thickness of 0.8 mm and subjected to annealing in the range from 850° C. to 950° C. for a duration of 1 min or more. Subsequently, the steel sheets were subjected to electrolytic pickling at 80 C/dm$^2$ in a mixed acid solution containing nitric acid in a concentration of 15 mass % and hydrochloric acid in a concentration of 10 mass % for sample materials.

of TiN in 10 fields of view was counted and averaged to calculate the number of TiN per 1 mm$^2$. The calculated numbers of TiN were given in Table 6.

The prepared sample materials were processed by heat treatment in the atmosphere at 900° C. for 5 min to form oxide films on the surfaces. To evaluate the removal performance for the temper color, the sample materials where the temper colors were formed were dipped in a mixed acid solution containing hydrofluoric acid in a concentration of 5 mass % and nitric acid in a concentration of 10 mass % for 20 sec. After the dipping, the element distribution in the depth direction was measured from the surface with Glow Discharge Spectroscopy (GDS). The condition where a larger amount of the chemical elements such as Si and Al concentrated in the temper color was seen in the surface layer compared with that in the stainless steel itself was determined as the insufficient removal of the temper color. The case where the concentration of the chemical elements

TABLE 5

| Steel No | C | Si | Mn | P | S | Cr | Ni | Mo | Al | Ti | Nb | V | N | Other Chemical Elements | Mn/Si | Remarks |
|---|---|---|---|---|---|---|---|---|---|---|---|---|---|---|---|---|
| | mass % | | | | | | | | | | | | | | | |
| A1 | 0.006 | 0.07 | 0.36 | 0.02 | 0.001 | 22.7 | 0.14 | 1.02 | 0.05 | 0.35 | 0.002 | 0.01 | 0.009 | | 5.1 | Inventive Example |
| A2 | 0.004 | 0.08 | 0.36 | 0.02 | 0.001 | 24.2 | 0.20 | 1.05 | 0.04 | 0.34 | 0.011 | 0.03 | 0.008 | | 4.5 | Inventive Example |
| A3 | 0.003 | 0.10 | 0.40 | 0.02 | 0.001 | 26.5 | 0.11 | 0.89 | 0.12 | 0.35 | 0.004 | 0.03 | 0.008 | | 4.0 | Inventive Example |
| A4 | 0.003 | 0.28 | 0.39 | 0.02 | 0.001 | 22.5 | 0.12 | 0.84 | 0.05 | 0.36 | 0.004 | 0.02 | 0.009 | | 1.4 | Inventive Example |
| A5 | 0.013 | 0.14 | 0.33 | 0.01 | 0.001 | 22.8 | 0.18 | 0.97 | 0.07 | 0.34 | 0.030 | 0.02 | 0.021 | | 2.4 | Inventive Example |
| A6 | 0.010 | 0.12 | 0.64 | 0.02 | 0.002 | 22.3 | 0.13 | 0.96 | 0.05 | 0.33 | 0.003 | 0.05 | 0.022 | | 5.3 | Inventive Example |
| A7 | 0.012 | 0.11 | 1.89 | 0.02 | 0.002 | 22.6 | 0.10 | 0.95 | 0.03 | 0.32 | 0.004 | 0.05 | 0.022 | | 17.2 | Inventive Example |
| A8 | 0.008 | 0.12 | 0.42 | 0.02 | 0.002 | 23.0 | 0.09 | 0.99 | 0.03 | 0.32 | 0.015 | 0.04 | 0.010 | | 3.5 | Inventive Example |
| A9 | 0.008 | 0.11 | 0.43 | 0.02 | 0.001 | 23.1 | 0.18 | 0.98 | 0.04 | 0.39 | 0.017 | 0.03 | 0.010 | | 3.9 | Inventive Example |
| A10 | 0.005 | 0.09 | 0.43 | 0.03 | 0.002 | 23.5 | 0.04 | 1.51 | 0.05 | 0.50 | 0.018 | 0.05 | 0.008 | | 4.8 | Inventive Example |
| A11 | 0.004 | 0.09 | 0.42 | 0.03 | 0.001 | 22.4 | 0.10 | 1.68 | 0.05 | 0.37 | 0.018 | 0.05 | 0.007 | | 4.7 | Inventive Example |
| A12 | 0.006 | 0.10 | 0.38 | 0.03 | 0.001 | 23.0 | 0.12 | 1.06 | 0.05 | 0.39 | 0.011 | 0.07 | 0.007 | | 3.8 | Inventive Example |
| A13 | 0.005 | 0.10 | 0.38 | 0.02 | 0.001 | 25.1 | 0.11 | 1.01 | 0.06 | 0.37 | 0.004 | 0.04 | 0.008 | Cu: 0.4 | 3.8 | Inventive Example |
| A14 | 0.005 | 0.10 | 0.36 | 0.02 | 0.003 | 25.3 | 0.09 | 1.03 | 0.03 | 0.32 | 0.005 | 0.02 | 0.009 | Zr: 0.1, W: 0.1 | 3.6 | Inventive Example |
| A15 | 0.011 | 0.07 | 0.35 | 0.02 | 0.001 | 25.0 | 0.10 | 1.05 | 0.05 | 0.33 | 0.005 | 0.03 | 0.010 | B: 0.002 | 5.0 | Inventive Example |
| B1 | 0.013 | 0.05 | 0.38 | 0.03 | 0.001 | 30.5 | 0.10 | 1.01 | 0.04 | 0.35 | 0.005 | 0.04 | 0.010 | | 7.6 | Comparative Example |
| B2 | 0.010 | 0.06 | 0.11 | 0.02 | 0.002 | 22.7 | 0.13 | 0.99 | 0.05 | 0.35 | 0.006 | 0.04 | 0.008 | | 1.8 | Inventive Example |
| B3 | 0.007 | 0.40 | 0.35 | 0.02 | 0.002 | 22.7 | 0.12 | 0.97 | 0.04 | 0.34 | 0.004 | 0.04 | 0.008 | | 0.9 | Comparative Example |
| B4 | 0.007 | 0.10 | 0.35 | 0.03 | 0.002 | 22.8 | 0.13 | 0.98 | 0.19 | 0.33 | 0.004 | 0.05 | 0.009 | | 3.5 | Comparative Example |
| B5 | 0.007 | 0.11 | 0.36 | 0.03 | 0.001 | 23.0 | 0.12 | 0.99 | 0.04 | 0.18 | 0.003 | 0.05 | 0.009 | | 3.3 | Comparative Example |
| B6 | 0.009 | 0.11 | 0.38 | 0.02 | 0.001 | 22.9 | 0.13 | 1.00 | 0.06 | 0.27 | 0.101 | 0.04 | 0.010 | | 3.5 | Comparative Example |
| B7 | 0.008 | 0.12 | 0.39 | 0.02 | 0.001 | 23.0 | 0.11 | 1.01 | 0.06 | 0.37 | 0.002 | 0.21 | 0.009 | | 3.3 | Comparative Example |

Note:
Under line indicates a value out of the range of the present invention

The surfaces of the prepared sample materials were observed through SEM and the distribution density of TiN existing on the surface was obtained with the method described below. Firstly, 10 fields of view in a range of 100 μm×100 μm on the surface of the sample material were arbitrarily observed through SEM so as to observe the precipitates on the surface. Among the observed precipitates, a precipitate in a shape that has a grain diameter of 1 μm or more and is close to a cubical crystal is assumed to be TiN. In the measurement method of the grain diameter of the precipitate, the respective major axis and minor axis of the TiN observed through SEM were measured and the average of the measurements was set to a grain diameter. The number such as Si and Al was not seen in the surface layer also after dipping was indicated by ◎. The case where the concentration of one chemical element among the chemical elements such as Si and Al was seen was indicated by ○ (satisfactory). The case where the concentration of two or more chemical elements was seen was indicated by x (unsatisfactory). The result is given in the column of the removal performance for the oxide film by the oxidation test in Table 6.

In No. 3-1 through 3-3, No. 3-5 through 3-15 as inventive examples, the concentration of the chemical element such as Si and Al was not seen. In No. 3-4, which is an inventive example but has Mn/Si<2.0, a slight concentration of Si alone was seen. In No. 3-16, Cr is equal to or more than the preferred upper limit of the present invention, the concentration of the chemical elements such as Cr, Si, and Al was seen in the surface layer also after dipping. In No. 3-17, the Mn content was less than 0.30, which was within the range of Embodiment 1 and out of the range of to Embodiment 3, and the concentration of the chemical elements such as Cr, Si, and Al was seen in the surface layer also after dipping. In No. 3-18, Si was equal to or more than the preferred upper limit of the present invention, and the concentration of the chemical elements such as Cr, Si, and Al was seen in the surface layer also after dipping. In No. 3-19, Al was equal to or more than the preferred upper limit of the present invention, and the concentration of the chemical elements such as Cr, Si, and Al was seen in the surface layer also after dipping. In No. 3-20, Ti and the number of TiN existing on the surface were equal to or less than the preferred lower limit of the present invention, and the concentration of the chemical elements such as Cr, Si, and Al was seen in the surface layer also after dipping. In No. 3-21, Ti and the number of TiN existing on the surface were equal to or less than the preferred lower limit of the present invention and Nb was equal to or more than the preferred upper limit of the present invention, and the concentration of the chemical elements such as Cr, Si, and Al was seen in the surface layer also after dipping. In No. 3-22, V is equal to or more than the preferred upper limit of the present invention, and the concentration of the chemical elements such as Cr, Si, and Al was seen in the surface layer also after dipping. In No. 3-23, while the inventive steel was employed, the pickling weight loss was 0.21 g/m$^2$, which is insufficient, and the number of TiN was equal to or less than the preferred lower limit of the present invention. Thus the concentration of the chemical elements such as Cr, Si, and Al was seen in the surface layer also after dipping.

To evaluate the corrosion resistance after the removal of the temper color by dipping in the mixed acid solution, the cyclic corrosion test was carried out. The testing conditions of the cyclic corrosion test were in accordance with JASO M 609-91. The cyclic condition was set to 3 cycles including processes of salt spray (5% NaCl, 35° C., spraying for 2 hours) to drying (60° C., 4 hours, relative humidity of 40%) to moistening (50° C., 2 hours, relative humidity≥95%) as 1 cycle. The condition where the corrosion did not occur due to the cyclic corrosion test was determined as an excellent corrosion resistance. The case where the corrosion did not occur due to the cyclic corrosion test was indicated by ○ (satisfactory). The case where the corrosion occurred was indicated by x (unsatisfactory). The result is given in the column of the existence or nonexistence of corrosion in the cyclic corrosion test after the removal of the oxide film in Table 6.

In all of No. 3-1 through No. 3-15 as the inventive examples, the corrosion was not seen after the cyclic corrosion test. In all of No. 3-16 and No. 3-18 through 3-23 as the comparative examples, the corrosion was seen after the cyclic corrosion test. Also in 3-17, which was the inventive example but out of the range of Embodiment 3, the corrosion was seen.

Bead on plate using TIG welding was performed on the prepared sample materials. The welding current was set to 90 A and the welding speed was set to 60 cm/min. As the shielding gas, 100% Ar was used only on the front side (welding electrode side) while the shielding gas was not used on the back side. The flow rate of the shielding gas was set to 15 L/min. The width of the weld bead on the front side was about 4 mm.

An absorbent cotton wet with a phosphoric acid solution in a concentration of 10 mass % was brought into contact with the temper colors on the front side and back side of the prepared weld bead. Then, an electrolytic treatment was performed while the electric quantity/area was varied in the range from 1 C/dm$^2$ to 15 C/dm$^2$. After the electrolytic treatment, the element distribution of the welded portion in the depth direction was measured with GDS. The condition where a larger amount of the chemical elements such as Si and Al concentrated in the temper color was seen in the surface layer compared with that in base iron was determined as the existence of the residual temper color. The case where there was no residual temper color in the electrolytic treatment at an electric quantity/area of 6 C/dm$^2$ or less was indicated by ◎ (satisfactory, significantly excellent). The case where there was no residual temper color in the electrolytic treatment at an electric quantity/area of 10 C/dm$^2$ or less was indicated by ○ (satisfactory, excellent). The case where there was a residual temper color in the electrolytic treatment at an electric quantity/area of more than 10 C/dm$^2$ was indicated by x (unsatisfactory). The result was given in the column of the existence or nonexistence of the residual temper color of the weld bead in Table 6.

As given in Table 6, No. 3-1 through 3-15 and 3-17 as the examples of present invention had significantly excellent results in the evaluation of the residual temper color of the weld bead. In contrast, in No. 3-16 and 3-18 through 3-23 as the comparative examples, the residual temper color was seen. The results of the evaluation of the removal performance for the oxide film by the oxidation test described above and the evaluation of this temper-color removal performance confirmed that this embodiment had a significantly excellent removal performance for the temper color.

The weld bead of the sample material was processed by the electrolytic treatment in the phosphoric acid solution in a concentration of 10 mass %. Subsequently, the specimens including a weld bead length of 50 mm were cut and dipped in NaCl in a concentration of 5 mass % at 80° C. for one week. After the dipping, the existence or nonexistence of corrosion was investigated. The immersion test was carried out on the sample material with no corrosion for one more week, and then the existence or nonexistence of corrosion was investigated. The result is given in the column of the existence or nonexistence of corrosion in the immersion test after the removal of the temper color in Table 6. The case where there was corrosion after dipping for one week was indicated by x (unsatisfactory). The case where there was no corrosion after dipping for one week but there was corrosion after dipping for two weeks was indicated by ○ (satisfactory, excellent). The case where there was no corrosion after two weeks was indicated by ◎ (satisfactory, significantly excellent).

As given in Table 6, in No. 3-17 as the example of present invention, the corrosion was not seen after the test for two weeks. In the other examples, the corrosion was not seen after the test for one week but the corrosion was confirmed after the test for two weeks. As just described, the inventive examples in Example 3 had high Mn contents and are thus inferior to Embodiment 1 and Embodiment 2. However, as described above, an excellent corrosion resistance is ensured.

The above-described sample materials with the sheet thickness of 0.8 mm manufactured with the above-described method were processed into a tensile test specimens in accordance with JIS No. 13B for 0° (L direction), 45° (D direction), and 90° (C direction) with respect to the rolling direction. A tensile test was carried out twice for each direction so as to measure the weighted average ((L+2D+C)/4) of the elongation in the three directions. The tension rate was set to 10 ram/min, and the gauge length was set to 50 mm. The case where the obtained weighted average of the elongation in the three directions was 28% or more was indicated by ⊙ (satisfactory, excellent). The case where the weighted average was 25% or more and less than 28% was indicated by ○ (satisfactory) as an excellent workability. The case where the weighted average was less than 25% was indicated by x (unsatisfactory). The result was given in the column of the elongation (average of the three directions) in Table 6.

As given in Table 6, it was confirmed that all the sample materials had elongations of 25% or more except the comparative examples.

TABLE 6

| No | Steel Type | Distribution Density of TiN having 1 μm or more particles/mm$^2$ | Removal Performance for Oxide Film by Oxidation Test | Existence or Nonexistence of Corrosion in Cyclic Corrosion Test after Removal of Oxide Film | Existence or Nonexistence of Residual Temper Color of Weld Bead | Existence or Nonexistence of Corrosion in Immersion Test after Removal of Temper Color | Elongation (Average of Three Directions) | Remarks |
|---|---|---|---|---|---|---|---|---|
| 3-1 | A1 | 55 | ◎ | ○ | ◎ | ○ | ◎ | Inventive Example |
| 3-2 | A2 | 48 | ◎ | ○ | ◎ | ○ | ◎ | Inventive Example |
| 3-3 | A3 | 49 | ◎ | ○ | ◎ | ○ | ◎ | Inventive Example |
| 3-4 | A4 | 52 | ○ | ○ | ◎ | ○ | ◎ | Inventive Example |
| 3-5 | A5 | 55 | ◎ | ○ | ◎ | ○ | ◎ | Inventive Example |
| 3-6 | A6 | 47 | ◎ | ○ | ◎ | ○ | ◎ | Inventive Example |
| 3-7 | A7 | 43 | ◎ | ○ | ◎ | ○ | ○ | Inventive Example |
| 3-8 | A8 | 39 | ◎ | ○ | ◎ | ○ | ◎ | Inventive Example |
| 3-9 | A9 | 51 | ◎ | ○ | ◎ | ○ | ◎ | Inventive Example |
| 3-10 | A10 | 72 | ◎ | ○ | ◎ | ○ | ◎ | Inventive Example |
| 3-11 | A11 | 45 | ◎ | ○ | ◎ | ○ | ◎ | Inventive Example |
| 3-12 | A12 | 49 | ◎ | ○ | ◎ | ○ | ◎ | Inventive Example |
| 3-13 | A13 | 48 | ◎ | ○ | ◎ | ○ | ◎ | Inventive Example |
| 3-14 | A14 | 40 | ◎ | ○ | ◎ | ○ | ◎ | Inventive Example |
| 3-15 | A15 | 41 | ◎ | ○ | ◎ | ○ | ◎ | Inventive Example |
| 3-16 | B1 | 52 | X | X | X | ○ | X | Comparative Example |
| 3-17 | B2 | 50 | X | X | ◎ | ◎ | ◎ | Inventive Example |
| 3-18 | B3 | 49 | X | X | X | X | ◎ | Comparative Example |
| 3-19 | B4 | 48 | X | X | X | X | ◎ | Comparative Example |
| 3-20 | B5 | 25 | X | X | X | X | ◎ | Comparative Example |
| 3-21 | B6 | 22 | X | X | X | X | ◎ | Comparative Example |
| 3-22 | B7 | 46 | X | X | X | X | ◎ | Comparative Example |
| 3-23 | A1 | 7 | X | X | X | X | ◎ | Comparative Example |

Note:
Under line indicates a value out of the range of the present invention

The invention claimed is:

1. A ferritic stainless steel having a composition containing, by mass %, C: 0.001% to 0.030%, Si: 0.03% to 0.30%, P: 0.05% or less, S: 0.01% or less, Cr: more than 22.0% to 28.0%, Mo: 0.2% to 3.0%, Al: 0.01% to 0.15%, Ti: more than 0.30% to 0.80%, V: 0.001% to 0.080%, and N; 0.001% to 0.050%; Mn: 0.05% to 0.30% and Ni: 0.01% to 5.00%, or Mn: 0.05% to 2.00% and Ni: 0.01% to 0.30%; Nb: 0.001% to 0.033%; and the balance being Fe and inevitable impurities, and having a surface where TiN having a grain diameter of 1 μm or more is distributed at a density of 30 particles/mm$^2$ or more.

2. The ferritic stainless steel according to claim 1, wherein the Mn content is 0.05% to 0.30%, and the Ni content is 0.01% to less than 0.30%.

3. The ferritic stainless steel according to claim 1, wherein NbN is precipitated on a surface of TiN having a grain diameter of 1 μm or more.

4. The ferritic stainless steel according to claim 1, wherein, by mass %, the Mn content is 0.05% to 0.30%, the Ni content is 0.30% to 5.00%, and the N content is 0.005% to 0.030%.

5. The ferritic stainless steel according to claim 1, wherein, by mass %, the Mn content is more than 0.30% to 2.00%, the Ni content is 0.01% to less than 0.30%, the S content is 0.005% or less, and the N content is 0.001% to 0.030%.

6. The ferritic stainless steel according to claim 5, wherein [Mn] as the Mn content and [Si] as the Si content satisfy a formula (1):

$$[Mn]/[Si]>2.0 \quad (1).$$

7. The ferritic stainless steel according to claim 1, wherein the steel has a chemical composition further containing one or more components selected from the group consisting of, by mass %, Cu: 1.0% or less, Zr: 1.0% or less, W: 1.0% or less, and B: 0.1% or less.

8. A method for manufacturing a ferritic stainless steel, comprising:

cold rolling and annealing a steel having a component composition according to claim 1; and subsequently electrolytic pickling the steel for a pickling weight loss of 0.5 g/m$^2$ or more.

9. The ferritic stainless steel according to claim 2, wherein NbN is precipitated on a surface of TiN having a grain diameter of 1 μm or more.

10. The ferritic stainless steel according to claim 2, wherein the steel has a chemical composition further containing one or more components selected from the group consisting of, by mass %, Cu: 1.0% or less, Zr: 1.0% or less, W: 1.0% or less, and B: 0.1% or less.

11. The ferritic stainless steel according to claim 3, wherein the steel has a chemical composition further containing one or more components selected from the group consisting of, by mass %, Cu: 1.0% or less, Zr: 1.0% or less, W: 1.0% or less, and B: 0.1% or less.

12. The ferritic stainless steel according to claim 4, wherein the steel has a chemical composition further containing one or more components selected from the group consisting of, by mass %, Cu: 1.0% or less, Zr: 1.0% or less, W: 1.0% or less, and B: 0.1% or less.

13. The ferritic stainless steel according to claim 5, wherein the steel has a chemical composition further containing one or more components selected from the group consisting of, by mass %, Cu: 1.0% or less, Zr: 1.0% or less, W: 1.0% or less, and B: 0.1% or less.

14. The ferritic stainless steel according to claim 6, wherein the steel has a chemical composition further containing one or more components selected from the group consisting of, by mass %, Cu: 1.0% or less, Zr: 1.0% or less, W: 1.0% or less, and B: 0.1% or less.

15. A method for manufacturing a ferritic stainless steel, comprising:

cold rolling and annealing a steel having a component composition according to claim 2; and subsequently electrolytic pickling the steel for a pickling weight loss of 0.5 $g/m^2$ or more.

16. A method for manufacturing a ferritic stainless steel, comprising:

cold rolling and annealing a steel having a component composition according to claim 3; and subsequently electrolytic pickling the steel for a pickling weight loss of 0.5 $g/m^2$ or more.

17. A method for manufacturing a ferritic stainless steel, comprising:

cold rolling and annealing a steel having a component composition according to claim 4; and subsequently electrolytic pickling the steel for a pickling weight loss of 0.5 $g/m^2$ or more.

18. A method for manufacturing a ferritic stainless steel, comprising:

cold rolling and annealing a steel having a component composition according to claim 5; and subsequently electrolytic pickling the steel for a pickling weight loss of 0.5 $g/m^2$ or more.

19. A method for manufacturing a ferritic stainless steel, comprising:

cold rolling and annealing a steel having a component composition according to claim 6; and subsequently electrolytic pickling the steel for a pickling weight loss of 0.5 $g/m^2$ or more.

20. A method for manufacturing a ferritic stainless steel, comprising:

cold rolling and annealing a steel having a component composition according to claim 7; and subsequently electrolytic pickling the steel for a pickling weight loss of 0.5 $g/m^2$ or more.

* * * * *